US006659794B2

(12) United States Patent
Yamatani et al.

(10) Patent No.: US 6,659,794 B2
(45) Date of Patent: Dec. 9, 2003

(54) CONNECTOR FOR CONNECTING FFC

(75) Inventors: Eiji Yamatani, Tokyo (JP); Isao Yamaguchi, Tokyo (JP); Nozomi Itoh, Tokyo (JP); Shigeru Oyamada, Tokyo (JP); Shinji Itoh, Tokyo (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 10/094,505

(22) Filed: Mar. 11, 2002

(65) Prior Publication Data

US 2002/0146932 A1 Oct. 10, 2002

(30) Foreign Application Priority Data

Mar. 23, 2001 (JP) ..... P. 2001-085618
Mar. 30, 2001 (JP) ..... P. 2001-102255
Jun. 21, 2001 (JP) ..... P. 2001-188003

(51) Int. Cl.[7] ..... H01R 9/07

(52) U.S. Cl. ..... 439/495

(58) Field of Search ..... 439/495, 459

(56) References Cited

U.S. PATENT DOCUMENTS 3,103,399 A * 9/1963 Crimmins ..... 439/55
3,336,565 A * 8/1967 Martin ..... 439/459
5,897,394 A * 4/1999 Adachi ..... 439/496

* cited by examiner

*Primary Examiner*—Lynn Feild
*Assistant Examiner*—Phuong K Dinh
(74) *Attorney, Agent, or Firm*—Foley & Lardner

(57) ABSTRACT

Slits to be used for insertion of an FFC are formed in the root section of each of guide ribs of a male connector housing. A retainer provided integrally with the male connector housing is engaged with a rear-end opening section of the male connector housing. The FFC is sandwiched between a projecting section of the male connector housing and a recessed section of the male connector housing, in a folded manner.

6 Claims, 22 Drawing Sheets

CONNECTOR FOR CONNECTING FFC

BACKGROUND OF THE INVENTION

1. Field of the Invention

The present invention pertains to a connector to be used for connecting a flexible flat circuit (hereinafter abbreviated as "FFC") board for use in, e.g., an automobile, on a wiring board. Particularly, the present invention relates to an improvement in connection with reliability and ease of assembly of a connector.

2. Description of the Related Art

An electrical connector, such as that shown in FIGS. 38 and 39, has hitherto been used as an electrical connector of this type.

As shown in FIGS. 38 and 39, reference numeral 51 designates a male connector housing. The male connector housing 51 is constituted of a base member 55—which serves as a receiver for receiving an FFC 52—and a fixing member 56. The base member 55 is provided with a support section 55-1 on which the FFC 52 is to be placed, a slit 55-3 formed in the support section 55-1, and locating pins 55-2.

Attachment of the FFC 52 to the male connector housing 51 is performed by the following operations. Namely, the extremity of the FFC 52 is inserted into the slit 55-3 of the base member 55, and the locating pins 55-2 are fitted into holes 52-1 of the FFC 52.

Subsequently, the locating pins 55-2 of the base member 55 are fitted into holes 56-1 of the fixing member 56. Engagement latches 56-2 provided at respective ends of the fixing member 56 are engaged with engagement sections 55-5.

Reference numeral 53 designates a female connector housing which is formed from resin through injection molding. Contact terminals 54 are fitted into the female connector housing 53.

The contact terminals 54 are produced from a brass plate through press-molding. A solder tail 54-2 is formed at one end of each contact terminal 54 and inserted into and soldered to a through hole formed in a circuit board or a like board (not shown).

Two rod-like sections 54-3, each having a contact 54-1, are formed at the other end of each contact terminal 54.

By means of engaging the male connector housing 51 with the female connector housing 53, lock projections 55-4 of the base member 55 are fixedly engaged with engagement recesses 53-1 of the female connector housing 53. As a result, the rod-like sections 54-3 of the contact terminal 54 become elastically deformed, and the contacts 54-1 of the contact terminal 54 hold a conductor circuit section of the FFC 52, thereby electrically constituting a predetermined electric circuit.

However, in relation to such a related-art male connector housing 51, the lock projections 55-4 are formed on the base member 55. Hence, when connected to the female connector housing 53, the male connector 51 is susceptible to horizontal deflections. Engagement between the base member 55 and the FFC 52 is dependent primarily on the FFC 52 and the locating pins 55-2 of the base member 55. Hence, if strong tension is applied to the FFC 52, the FFC 52 is torn from the neighborhood of the holes 52-1 of the FFC 52.

In order to prevent occurrence of a tear, a method of securing the FFC 52 on the base member 55 by means of an adhesive is also employed. However, the method poses a problem of occurrence of a drop in workability.

Another problem is that the engagement section 55-5 hinders disconnection of the FFC 52 after the male connector 51 has been engaged with the female connector housing 53.

SUMMARY OF THE INVENTION

The present invention has been conceived in light of the foregoing problem and aims at providing a connector to be used for connecting an FFC, which connector has high connection reliability and improved ease of assembly.

A first configuration for achieving the object is characterized by a connector for connecting a flexible flat circuit (FFC) including a male connector housing having slits along which an FFC is inserted, and a retainer for fastening the FFC to the male connector housing, wherein the retainer is forced into an insertion side of the FFC and engaged with the male connector housing, thereby fastening the FFC between the retainer and the male connector housing in a folded manner.

According to a second configuration, the first configuration is characterized in that the slits are formed in a root of each of the guide ribs of the male connector housing.

A third configuration is characterized by a connector for connecting an flexible flat circuit (FFC) including a male connector housing having an insertion port along which an FFC is inserted, and a retaining member for fastening the FFC to the male connector housing, wherein the retaining member has slits along which an FFC is inserted and is inserted into and engaged with, at an inclination, the side of the male connector housing opposite to the side thereof into which the FFC is to be inserted, thereby fastening the FFC between the retaining member and the male connector housing in a folded manner.

According to a fourth configuration, the third configuration is characterized in that the retaining member can be retained in a temporarily-held state such that an insertion port into which the FFC is to be inserted becomes flush with the slits.

A fifth configuration is characterized by a connector for connecting an FFC in which an FFC is sandwiched between a male connector housing and a retainer, wherein the FFC is bent through 180° by the male connector housing and the retainer, to thereby form upper and lower surfaces, and an electrical connection section is formed on the upper and lower surfaces, respectively.

According to a sixth configuration, the fifth configuration is characterized in that the FFC is sandwiched between two large and small recessed sections and two large and small projecting sections of the retainer, and a bent portion of the FFC is formed at any point between the male connector housing and a portion of the retainer at which a change arises in the cross section of the retainer.

A seventh configuration of the present invention is characterized by a connector for connecting an FFC which includes a plug on which an FFC is to be provided and a housing to be fitted to the plug, wherein the plug has a boss section of small cross section and a seat section of large cross section, which are formed by means of a single upper surface and different lower surfaces of two stages; an engagement member for engaging the FFC is provided on the upper surface, and a projecting section and a recessed section are provided at an interface between the lower surfaces of two stages; an insertion hole and an opening section, which are to be fitted to the boss section and the seat section, are provided in the housing; and a recessed section and a projecting section are provided in a boundary section between the insertion hole and the opening section so as to come into contact with the projecting and recessed sections of the plug with the FFC sandwiched therebetween.

According to an eighth configuration of the present invention, the first configuration is further characterized in that a restriction member for restricting the FFC is provided on a lower surface of the seat section of the plug.

According to the invention, there is provided an electrical connection connector which constitutes a predetermined electrical circuit by means of fitting a male connector housing having an FFC attached thereto into a female connector housing having a contact terminal incorporated therein, wherein the male connector housing has a storage section which is constituted of a retaining surface for retaining the FFC, a ceiling surface provided at a position above the retaining surface, and guide grooves provided on respective sides of the retaining surface;

an engagement projection for meshing with an engagement hole formed in the FFC is provided on the retaining surface; and groove-like warpage spaces are formed in the ceiling surface located at a position above the engagement projection so as to extend from an insertion entrance for the FFC to an end of the storage section.

Preferably, one or a plurality of engagement projections are provided, and the projections may be provided in series or in shunt with each other with reference to the direction in which the FFC is to be inserted.

The warpage spaces for FFC formed in the ceiling section may assume a C-shaped, U-shaped, or V-shaped cross-sectional profile or other cross-sectional profile, so long as the spaces constrain deformation of the FFC which would be caused by the engagement projection.

According to the invention, a shape restriction section is provided on the retaining surface of the male connector housing for restricting and bending an extremity of the FFC downward.

BRIEF DESCRIPTIONS OF DRAWINGS

Figure 24:
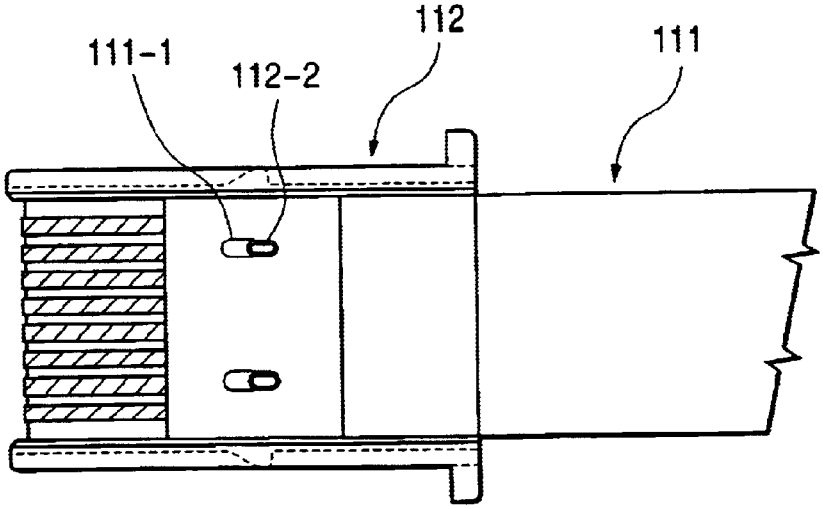
FIG. 24 is a plan view of a plug having an FFC provided thereon according to a fifth embodiment of the present invention.
Figure 25:
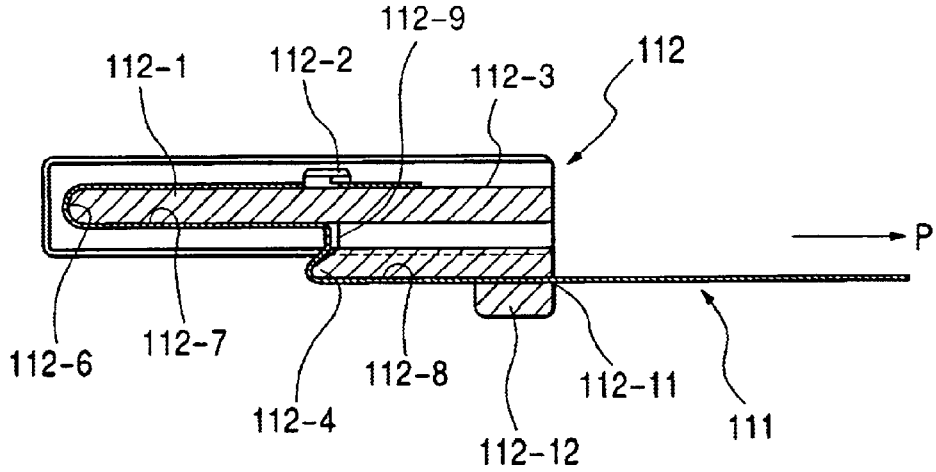

A FIG. 25 is a cross-sectional view of the plug shown in FIG. 24.

Figure 26:
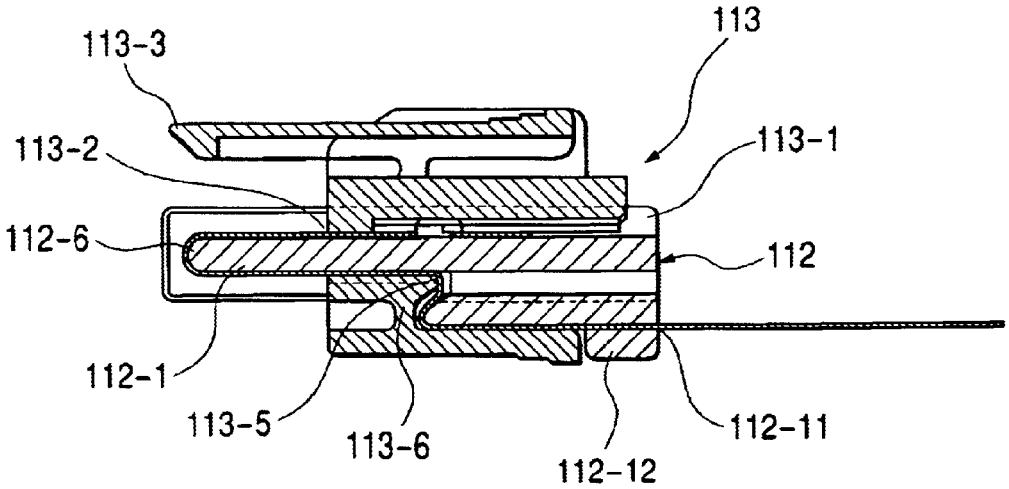

FIG. 26 is a cross-sectional view of a connector for connecting an FFC according to a fifth embodiment of the present invention.

Figure 27:
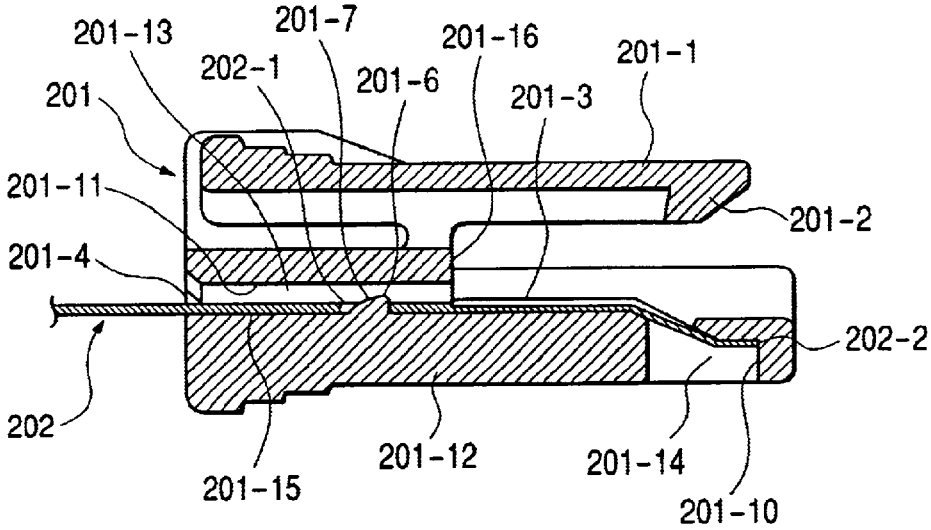

FIG. 27 is a cross-sectional view of a male connector housing according to a sixth embodiment of the present invention.

Figure 28:
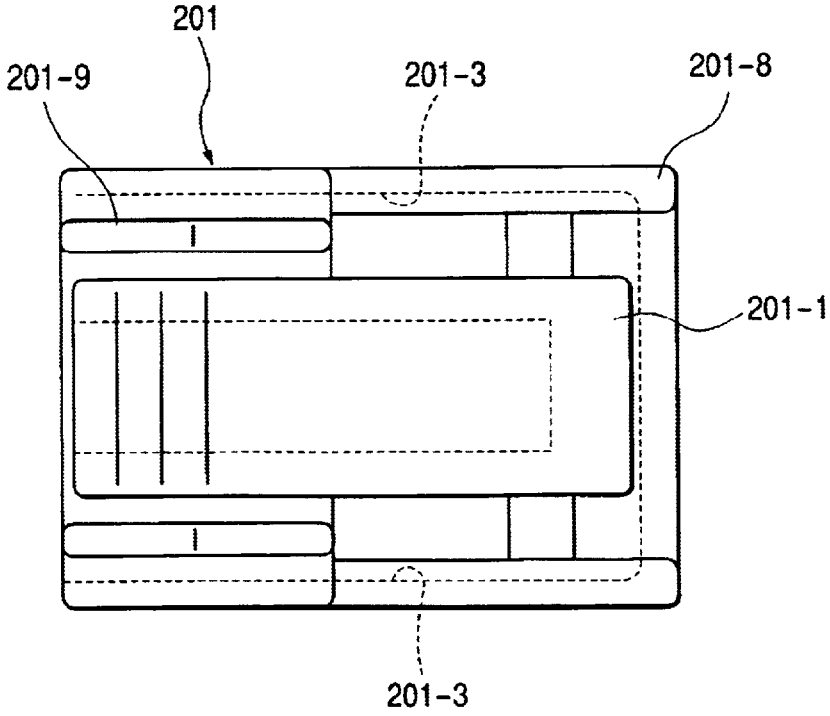

FIG. 28 is a plan view of a male connector housing according to the sixth embodiment.

Figure 29:
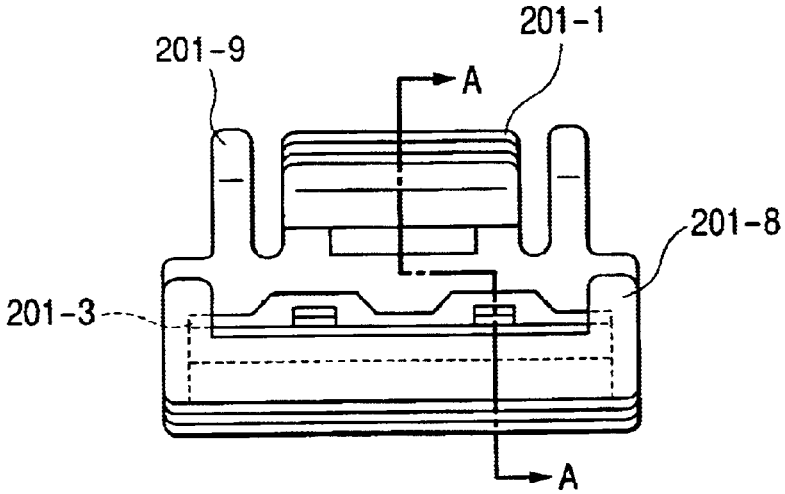

FIG. 29 is a side view of the connector housing shown in FIG. 27 when viewed from the right.

Figure 30:
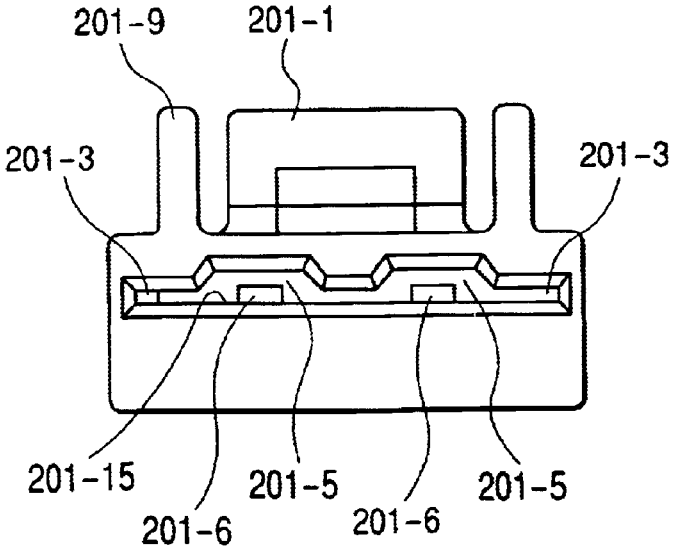

FIG. 30 is a left-side elevation view of the connector housing shown in FIG. 27 when viewed from the left.

Figure 31:
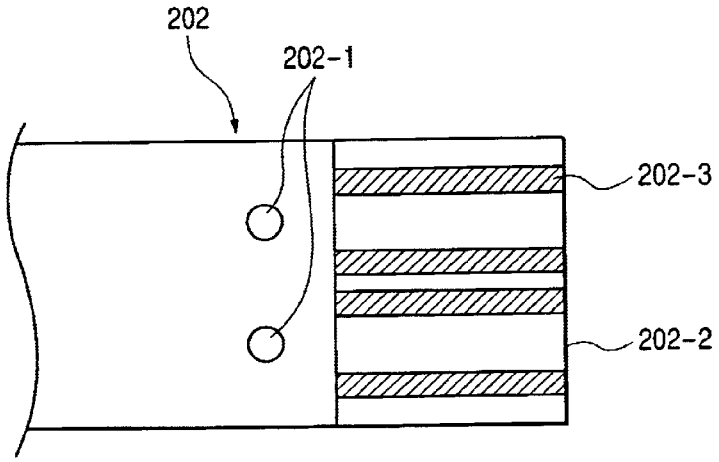

FIG. 31 is a plan view of an FFC 2 according to the sixth embodiment.

Figure 32:
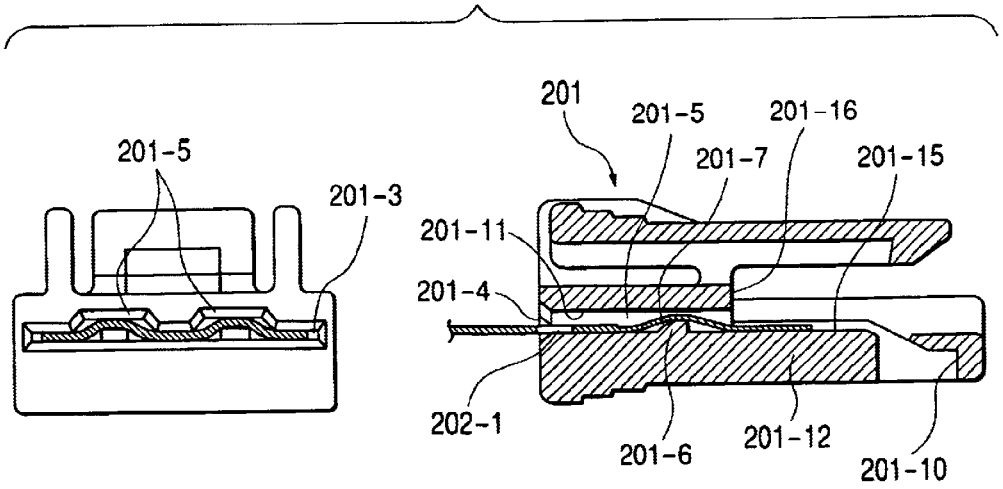

FIG. 32 is a descriptive view for describing the FFC 2 according to the sixth embodiment when being inserted into the male connector housing 1.

Figure 33:
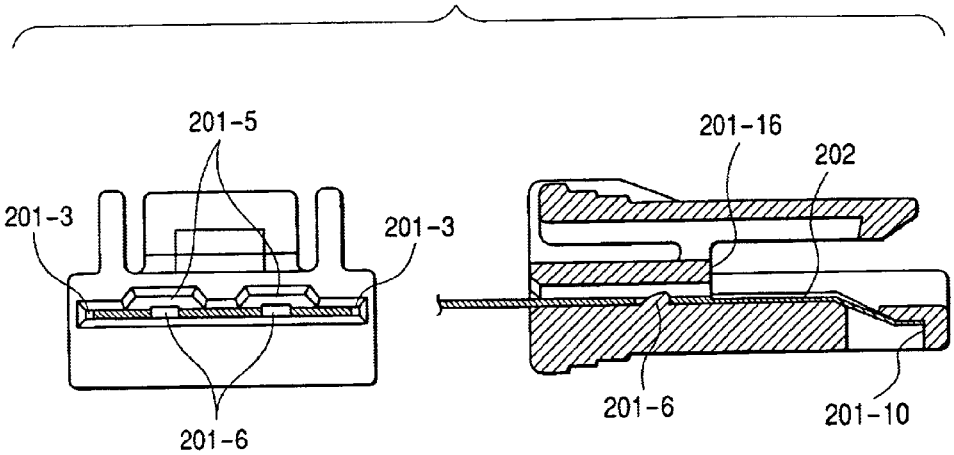

FIG. 33 is a descriptive view showing the FFC according to the sixth embodiment after having been inserted into the male connector housing 1.

Figure 34:
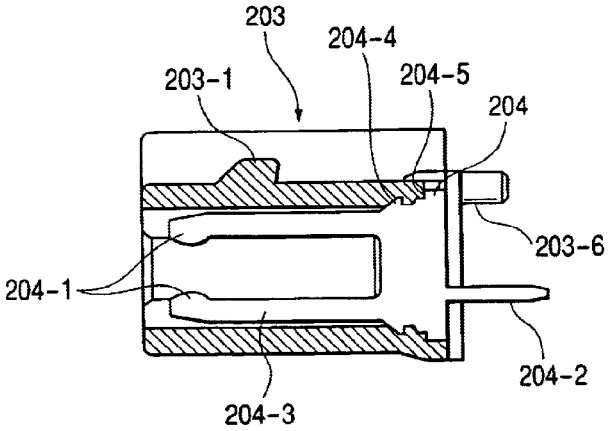

FIG. 34 is a cross-sectional view of a female connector housing according to the sixth embodiment when viewed from the front.

Figure 35:
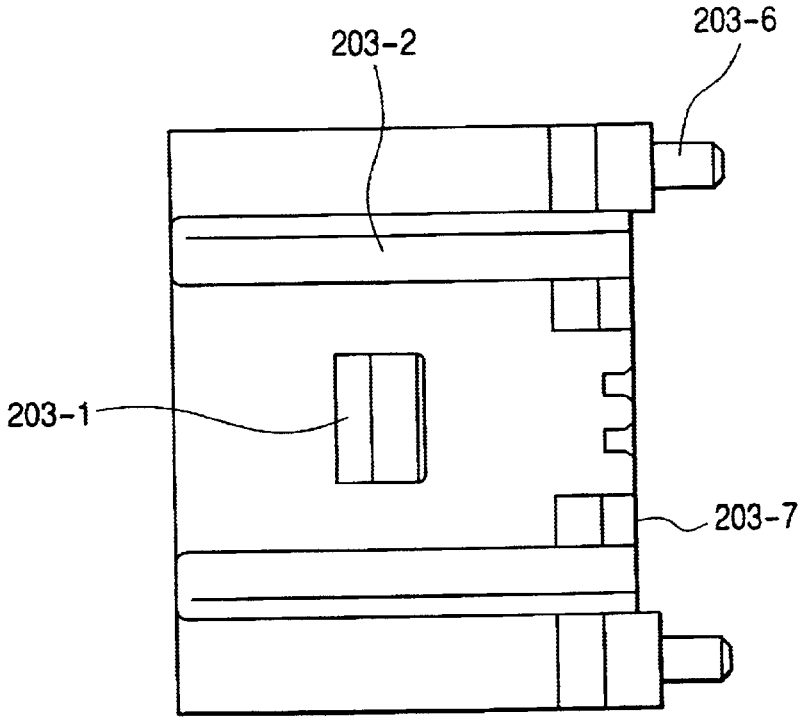

FIG. 35 is a plan view of a female connector housing 3 according to the sixth embodiment of the invention.

Figure 36:
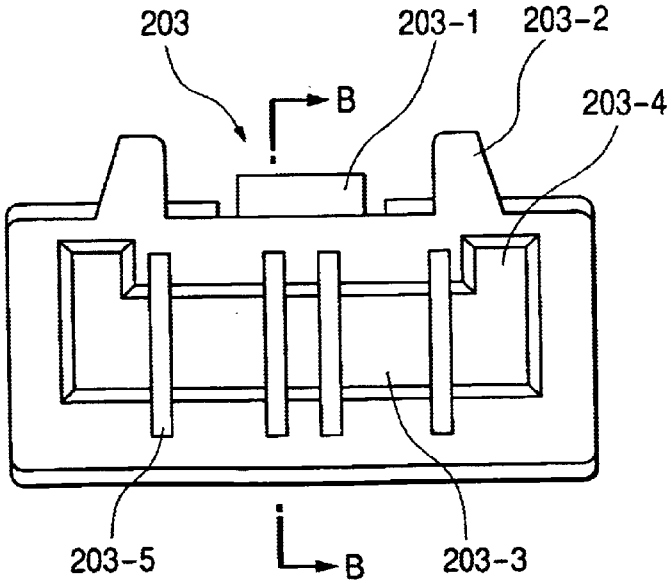

FIG. 36 is a side view of the female connector housing shown in FIG. 34 when viewed from the left.

Figure 37:
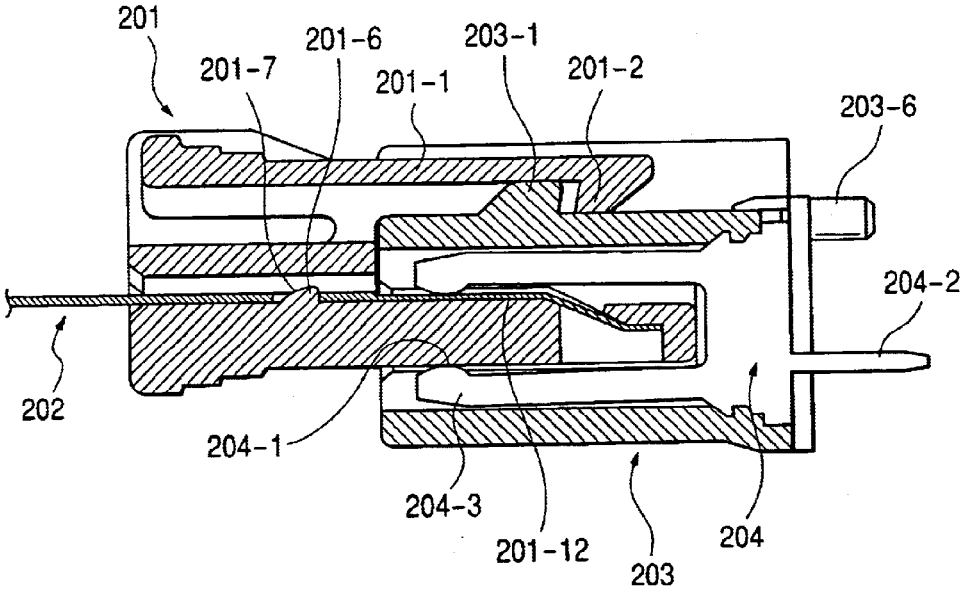

FIG. 37 is a cross-sectional view of the male connector housing and the female connector housing according to the present embodiment when they are engaged with each other.

Figure 38:
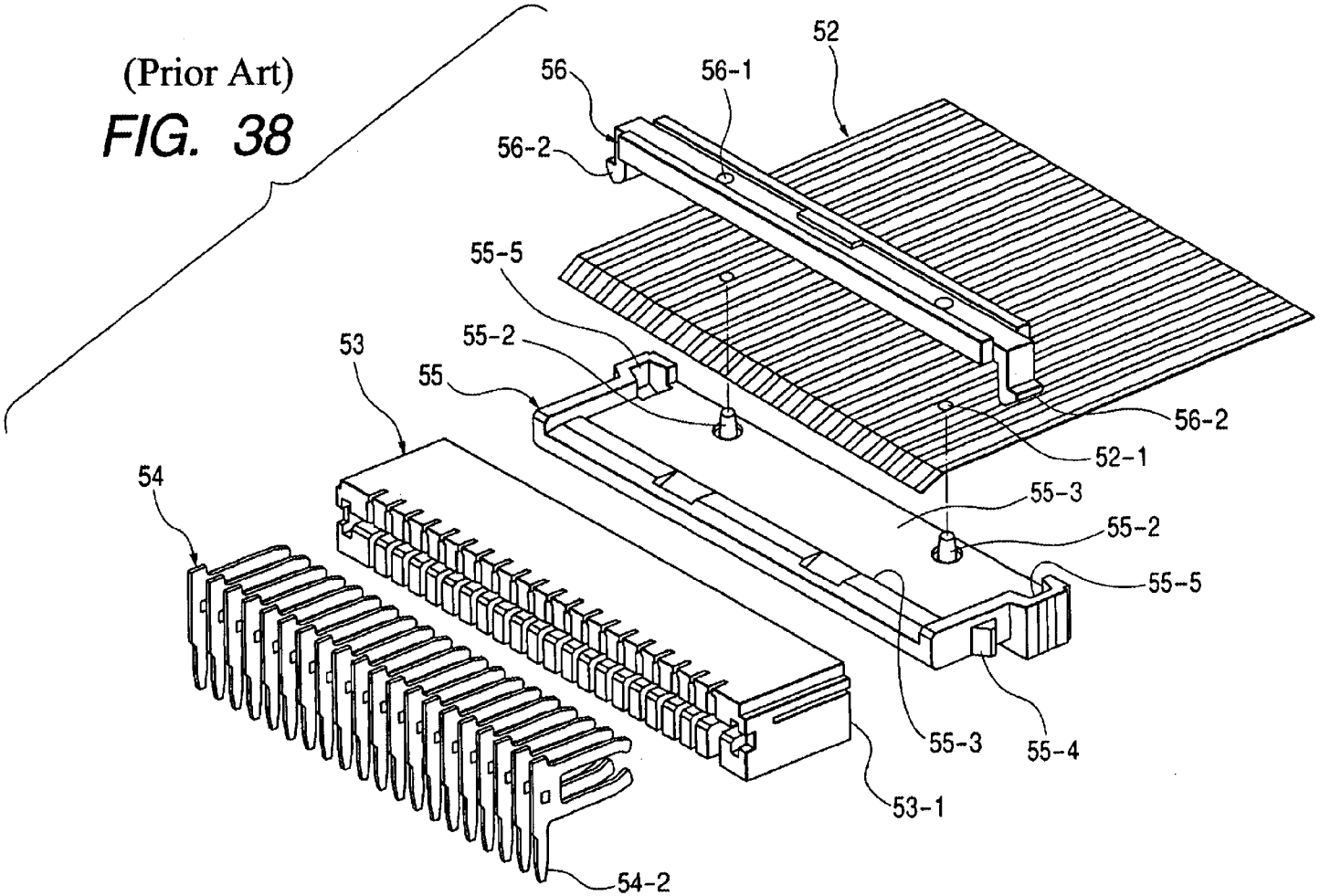
(Prior Art) FIG. 38

FIG. 38 is a perspective view of a related-art housing and a related-art female connector housing.

Figure 39:
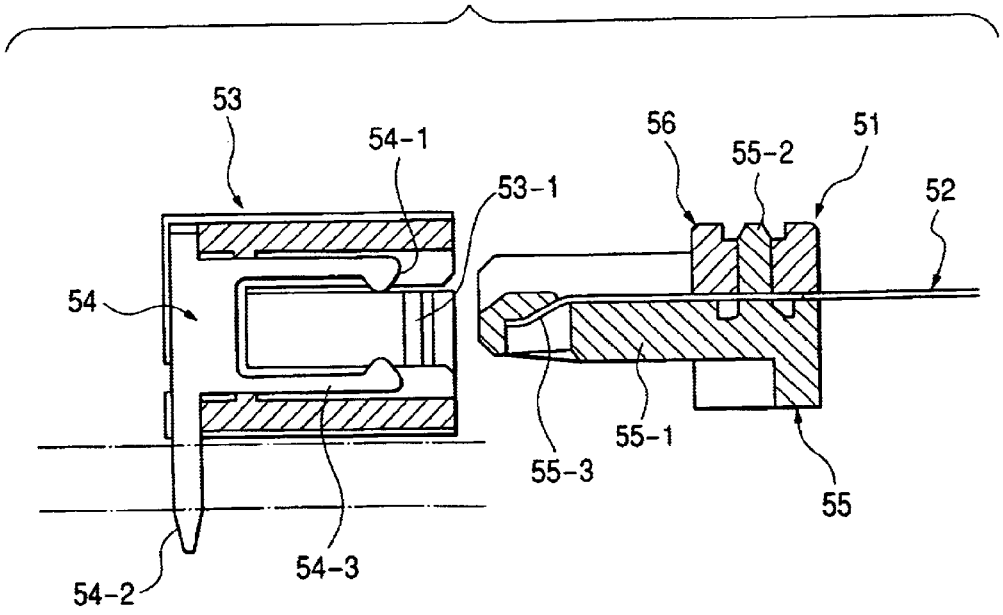
FIG. 39 (Prior Art)

FIG. 39 is a cross-sectional view of a related-art male connector housing and a related-art female connector housing.

DETAILED DESCRIPTION OF THE PRESENT INVENTION

The present invention will be described with reference to the accompanying drawings.

First Embodiment

Figure 1:
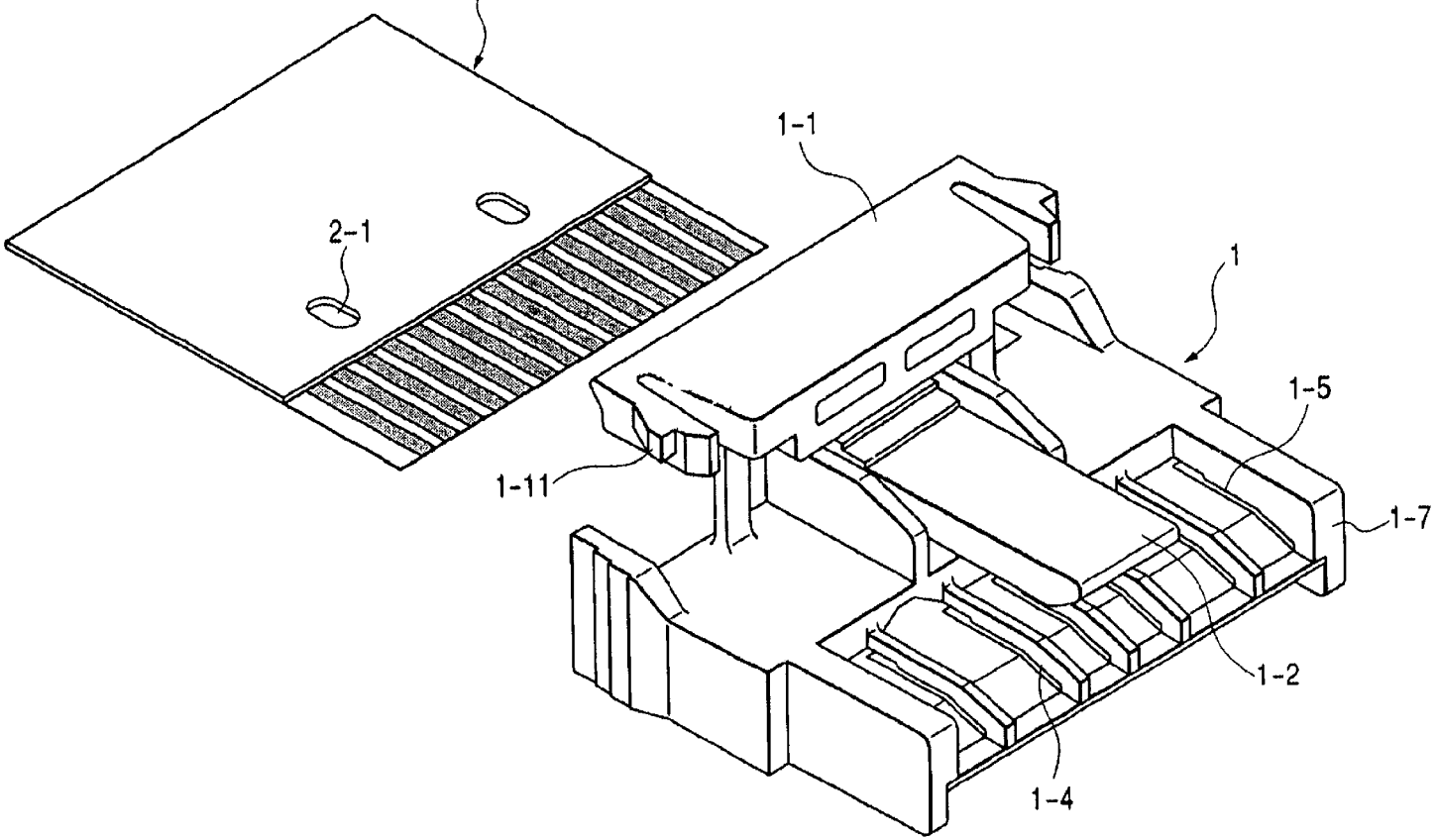
FIG. 1 is a perspective view of a male connector housing according to a first embodiment of the present invention before an FFC is attached to the male connector housing.
Figure 2:
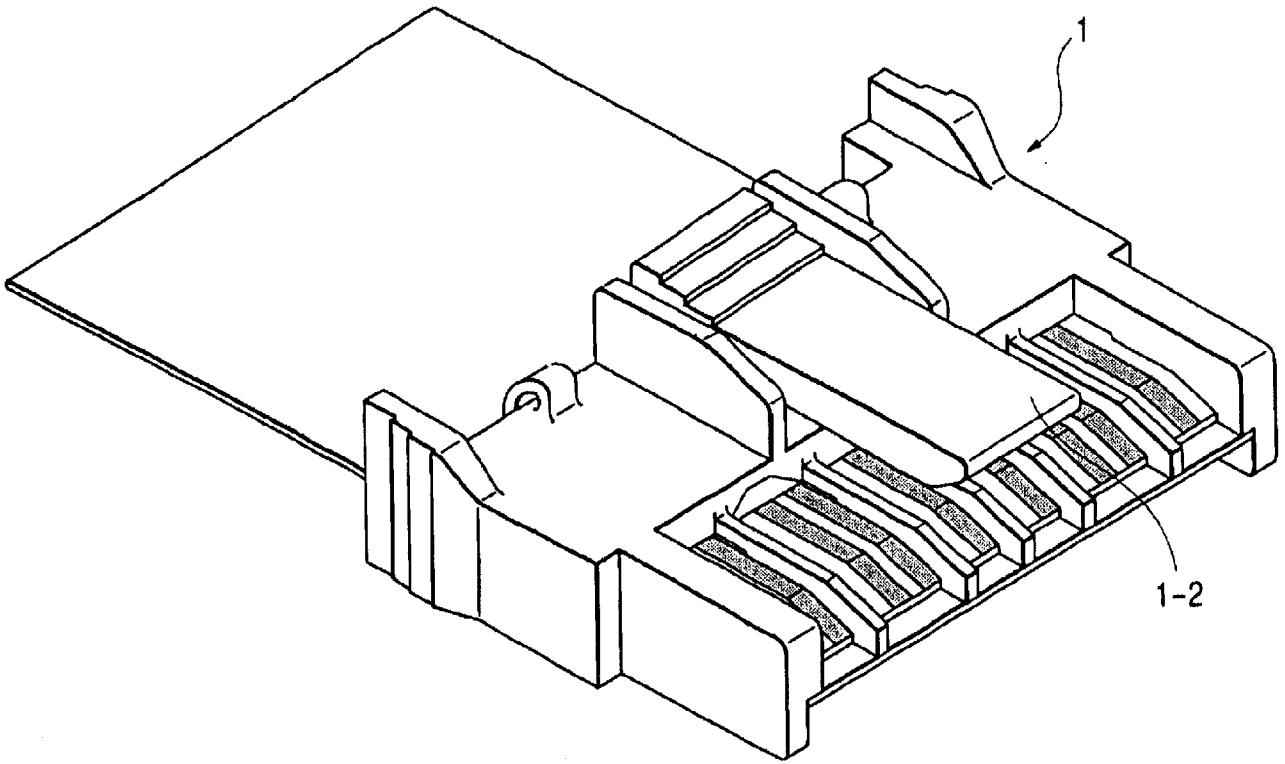
FIG. 2 is a perspective view of the male connector housing according to the first embodiment after the FFC has been attached to the male connector housing.
Figure 3:
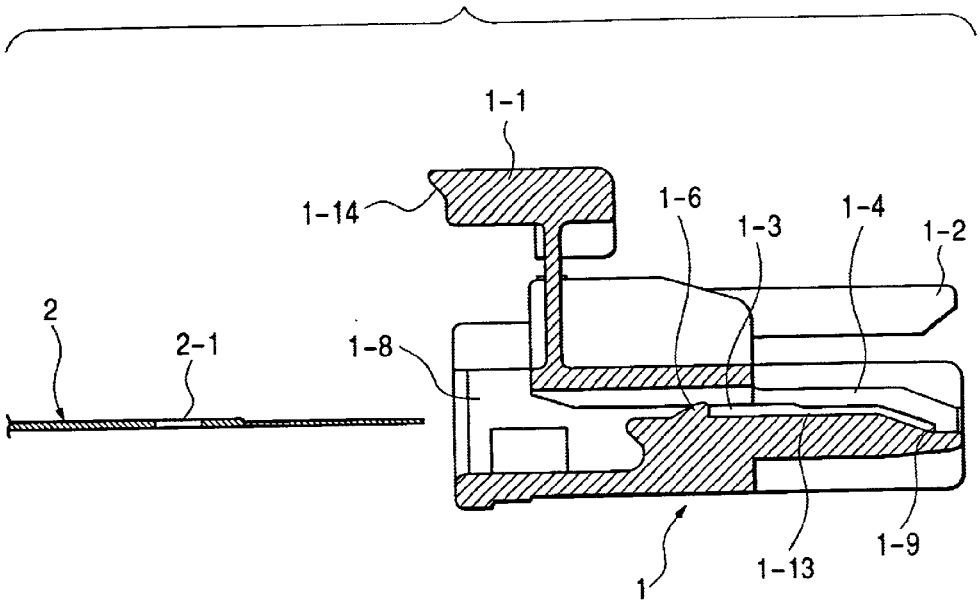
FIG. 3 is a cross-sectional view of the male connector housing according to the first embodiment before the FFC is attached to the male connector housing.

FIG. 1 is a perspective view of a male connector housing according to a first embodiment of the present invention before an FFC is attached to the housing. FIG. 2 is a perspective view of the male connector housing according to the first embodiment after the FFC has been attached to the connector housing. FIG. 3 is a cross-sectional view of the male connector housing according to the first embodiment before the FFC is attached to the male connector housing.

As shown in FIGS. 1 through 3, reference numeral 1 designates a male connector housing molded from resin through injection; and 2 designates an FFC. Reference numeral 1-1 designates a retainer for bending and fastening the FFC 2 to the male connector housing 1; 1-2 designates a lock to be used for preventing removal of the male connector housing 1 from a female connector housing 3 to be described later; and 1-4 designates a plurality of guide ribs to be used when the male connector housing 1 is engaged with the female connector housing 3. Reference numeral 1-7 designates side walls which are provided at the outside of the guide ribs 1-4 and have the function of guiding the male connector guide 1 when being inserted into the female connector housing 3.

Reference numeral 1-3 designates a slit formed in the root of each of the guide ribs 1-4; and 1-5 designates slits, each being formed in a part of the side wall 1-7. The FFC 2 is inserted into the male connector housing 1 along the slits 1-5. Reference numeral 1-6 designates a protuberance for latching the FFC 2.

Figure 4:
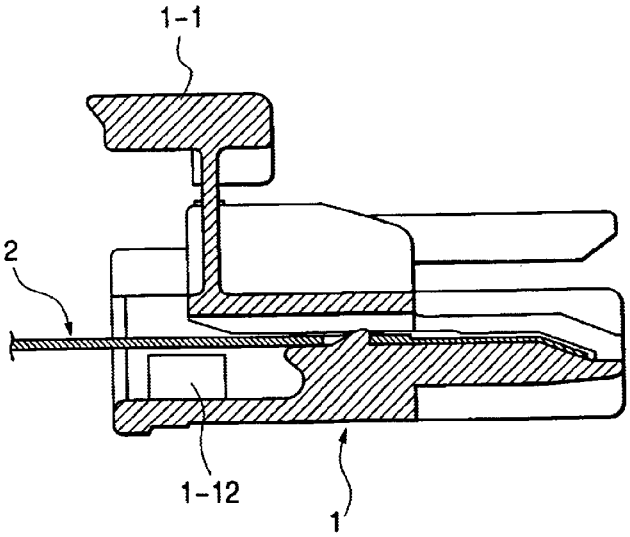
FIG. 4 is a cross-sectional view of the male connector housing according to the first embodiment after the FFC has been attached to the male connector housing.
Figure 5:
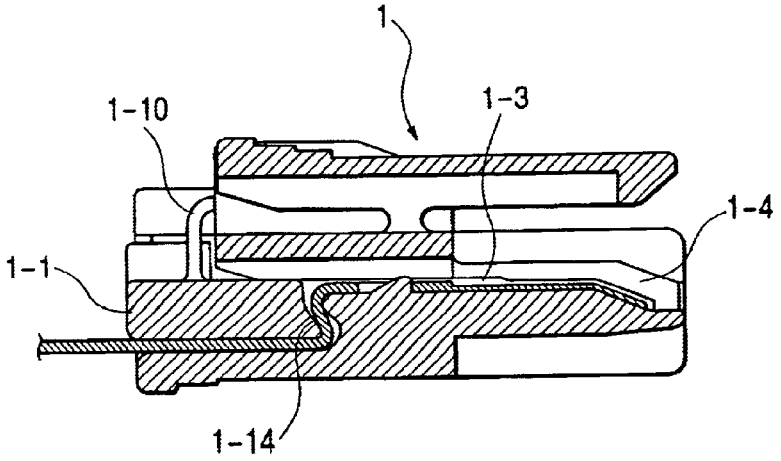
FIG. 5 is a cross-sectional view of a retainer according to the first embodiment after the retainer has been engaged with the male connector housing.

FIG. 4 is a cross-sectional view of the male connector housing 1 according to the first embodiment after the FFC 2 has been inserted into the male connector housing. FIG. 5 is a cross-sectional view of the male connector housing 1 after the retainer 1-1 according to the first embodiment has been latched into the male connector housing 1.

As shown in FIGS. 3 and 4, attachment of the FFC 2 to the male connector housing 1 is completed by means of inserting the FFC 2 into the male connector housing 1 by way of an opening section 1-8 until the FFC 2 passes through the slits 1-3, 1-5 and the protuberances 1-6 engage with the holes 2-1 of the FFC 2 at a position where an extremity 1-9 of the slit 1-3 comes into contact with the extremity of the FFC 2.

As shown in FIG. 5 the retainer 1-1 is fitted into the opening section 1-8 of the male connector housing 1 in the insertion direction of the FFC 2 while being folded along a hinge 1-10. Projections 1-11 provided at respective ends of the retainer 1-1 are engaged with indentations 1-12 in the male connector housing 1 (see FIG. 4).

The FFC 2 is sandwiched between a recessed portion of the male connector housing 1 and a projecting section 1-14 of the retainer 1-1 in a folded manner. Hence, even when large tensile force is exerted on the FFC 2, the FFC 2 is not torn from the neighborhood of the holes 2-1 of the FFC 2.

Since FFC 2 is inserted while being guided by the slits 1-3, 1-5, the FFC 2 will not separate from a retention surface 1-13 of the male connector housing 1. Further, the extremity of the FFC 2 is bent downwardly. For this reason, the extremity is not snagged when the male connector housing 1 is engaged with the female connector housing 3.

By virtue of the side walls 1-7 and the guide ribs 1-4, which are provided in the male connector housing 1 and act as guides, the male connector housing 1 can be smoothly engaged with the female connector housing 3.

In contrast with the related-art male connector housing, the male connector housing 1 is not divided into two components; that is, a base member 55 and a fixing member 56. Hence, costs related to parts are reduced, and improved ease of assembly is achieved.

Further, through injection molding, the retainer 1-1 is formed from resin so as to be integral with the male connector housing 1 via the hinge 1-10. As a result, costs related to components are reduced, and superior workability is achieved.

Figure 6:
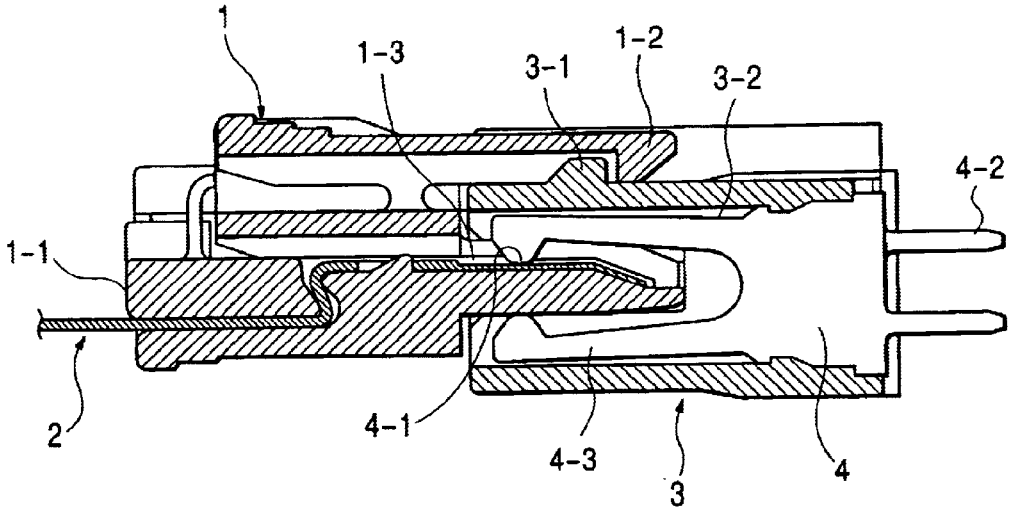
FIG. 6 is a cross-sectional view of the male connector housing according to the first embodiment when a female connector housing has been engaged with the male connector housing.

FIG. 6 is a cross-sectional view of the male connector housing 1 according to the first embodiment when engaged with the female connector housing 3.

As shown in FIG. 6, a contact terminal 4 into which a plurality of brass plates have been formed through press-molding is provided in an internal space 3-2 of the female connector housing 1, which is formed from resin through injection molding. One end of the contact terminal 4 is formed into two rod-like sections 4-3, and a contact 4-1 is formed at the extremity of each rod-like section 4-3. The other end of the contact terminal 4 has a solder tail to be inserted into and soldered to a through hole of a circuit board (not shown).

When the female connector housing 3 is engaged with the male connector housing 1, the locks 1-2 of the male connector housing 1 mesh with projections 3-1 of the female connector housing 3, thus hindering disconnection of the connector housings 1, 3.

At this time, the rod-like sections 4-3 of the contact terminal 4 become resiliently deformed, and the contacts 4-1 pinch a copper foil section of the FFC 2, thereby establishing electrical continuity and constituting a predetermined electrical circuit.

Second Embodiment

Figure 7:
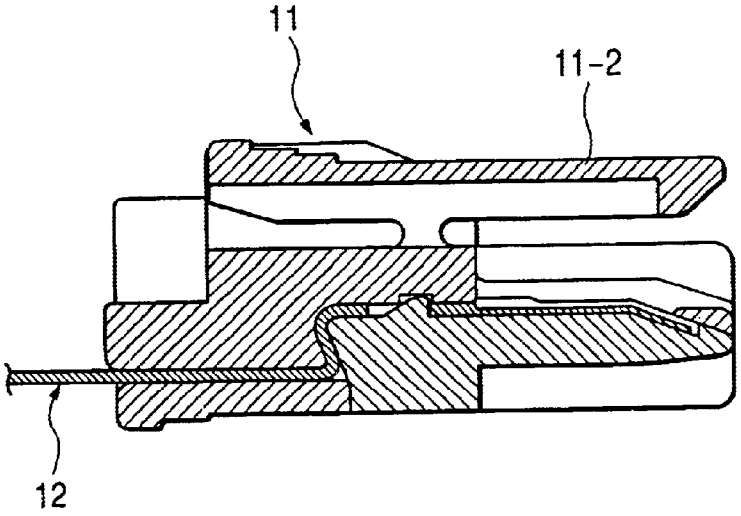
FIG. 7 is a cross-sectional view of a male connector housing according to a second embodiment of the present invention.
Figure 8:
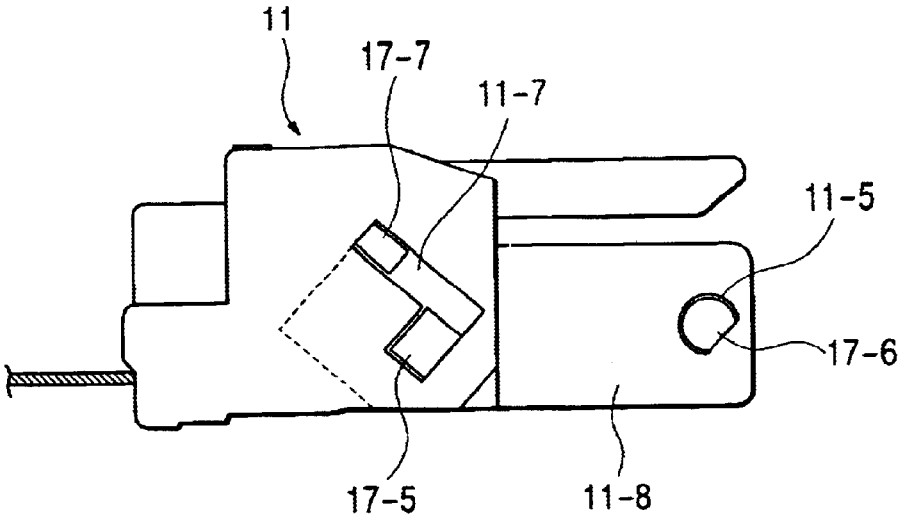
FIG. 8 is a front view of the male connector housing according to the second embodiment.
Figure 9:
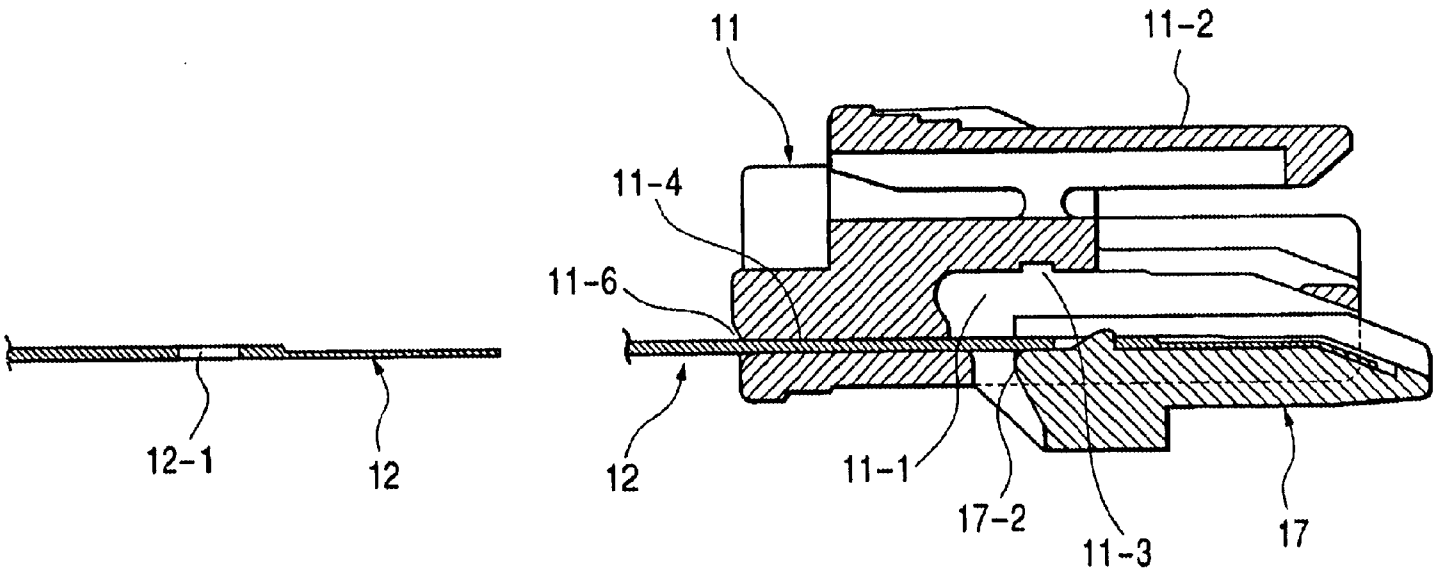
FIG. 9 is a cross-sectional view of the male connector housing before a retaining member according to the second embodiment is engaged with the male connector housing.
Figure 10:
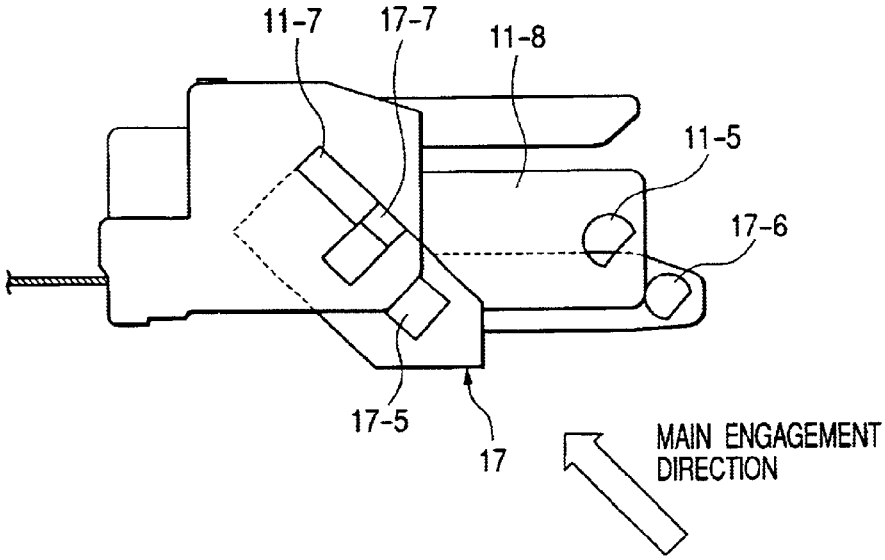
FIG. 10 is a front view of the male connector housing before the retaining member according to the second embodiment is engaged with the male connector housing.
Figure 11:
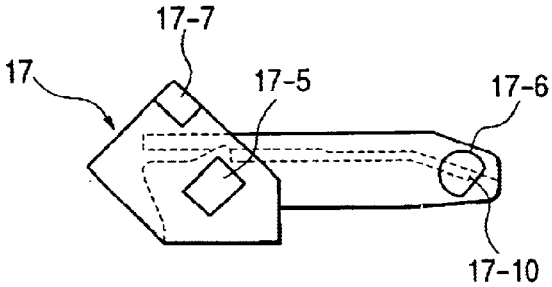
FIG. 11 is a front view of the retaining member according to the second embodiment.
Figure 12:
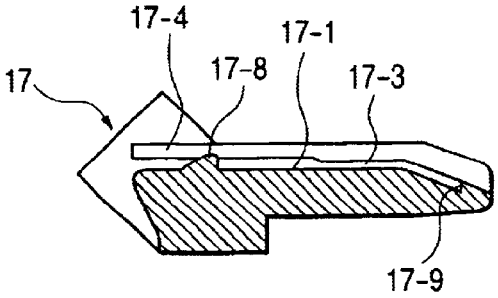
FIG. 12 is a cross-sectional view of the retaining member according to the second embodiment.

FIG. 7 is across-sectional view of a male connector housing according to a second embodiment of the present invention. FIG. 8 is a front view of the male connector housing according to the second embodiment. FIG. 9 is a cross-sectional view of the male connector housing before a retaining member according to the second embodiment is engaged with the housing. FIG. 10 is a front view of the male connector housing before the retaining member according to the second embodiment is engaged with the male connector housing. FIG. 11 is a front view of the retaining member according to the second embodiment. FIG. 12 is a cross-sectional view of the retaining member according to the second embodiment.

As shown in FIGS. 7 through 12, reference numeral 11 designates a male connector housing; 12 designates an FFC; and 17 designates a retaining member for retaining the FFC 12 in the male connector housing 11.

The male connector housing 11 comprises a lock 11-2 provided on an upper surface of the housing; a housing section 11-1 which is provided on a lower surface of the housing for housing the retaining member 17; an insertion opening 11-6; an insertion port 11-4; and a recessed groove 11-3 for avoiding occurrence of interference between the male connector housing 11 and a lock projection 17-8 of the retaining member 17.

An L-shaped engagement hole 11-7 and a semicircular engagement hole 11-5 are formed in the side wall 11-8 of the male connector housing 11 for holding the retaining member 17.

The retaining member 17 comprises a placement section 17-1 on which the FFC 12 is to be placed; a rectangular-parallelepiped engagement claw 17-5; a semicircular engagement claw 17-6; a rectangular-parallelepiped temporary engagement claw 17-7; a projection 17-8 to be engaged with the FFC 12; and guide ribs 17-4 guiding a female connector housing (not shown) when the male connector housing 11 is engaged with the female connector housing.

The retaining member 17 is temporarily retained such that a slit 17-3 becomes flush with the insertion port 11-4 of the male connector housing 11.

As shown in FIG. 9, attachment of the FFC 12 to the male connector housing 11 is performed by the following operations. Namely, the FFC 12 is inserted into the insertion opening 11-6 of the male connector housing 11 and passed through the insertion port 11-4. The FFC 12 then enters the slit 17-3 of the retaining member 17, which is temporarily engaged with the male connector housing 11. When the FFC 12 has come into contact with a tip-end section 17-9, a hole 12-1 of the FFC 12 meshes with the lock projection 17-8 of the retaining member 17.

Since the insertion port 11-4 of the male connector housing 11 is level with the slit 17-3 of the temporarily-held retaining member 17, improved ease of attachment of the FFC 12 is achieved. By means of inserting the retaining member 17 toward an engaging direction (as shown in FIG. 10), the engagement claw 17-5 engages with the L-shaped engagement hole 11-7 of the male connector housing 11, and the engagement claw 17-6 engages with the semicircular engagement hole 11-5 of the same.

The FFC 12 is lodged, in a collapsed manner, between a recessed portion of the housing section 11-1 of the male connector housing 11 and a projecting portion 17-2 of the retaining member 17. Further, when being pulled, the FFC 12 is lodged, in a collapsed manner, more strongly. For these reasons, even when tensile force is exerted on the FFC 12, a rip does not a rise in the periphery of the lock projection 17-8.

The second embodiment employs the retainer 1-1 described in connection with the first embodiment as a separate, independent member. Further, in the second embodiment, the retaining member 17 remaining in a temporarily-engaged state shown in FIGS. 9 and 10 is brought into a fully-engaged state shown in FIGS. 7 and 8. Hence, as in the case of the first embodiment, the female connector housing is inserted along the side walls 11-8 and the guide ribs 17-4, thus offering improved ease of engagement. There is yielded an advantage of a rip not arising in the periphery of the lock projection even when the FFC 12 is pulled strongly.

Since the retaining member 17 can first be set in a temporarily-engaged state, improved ease of assembly is achieved during mass production, thus providing a great advantage.

When the male connector housing 11 is engaged with the female connector housing (not shown), rod-like sections of a contact terminal are resiliently deformed, and contacts pinch a copper foil section of the FFC 12, thereby establishing electrical continuity and constituting a predetermined electrical circuit.

Third Embodiment

Figure 13:
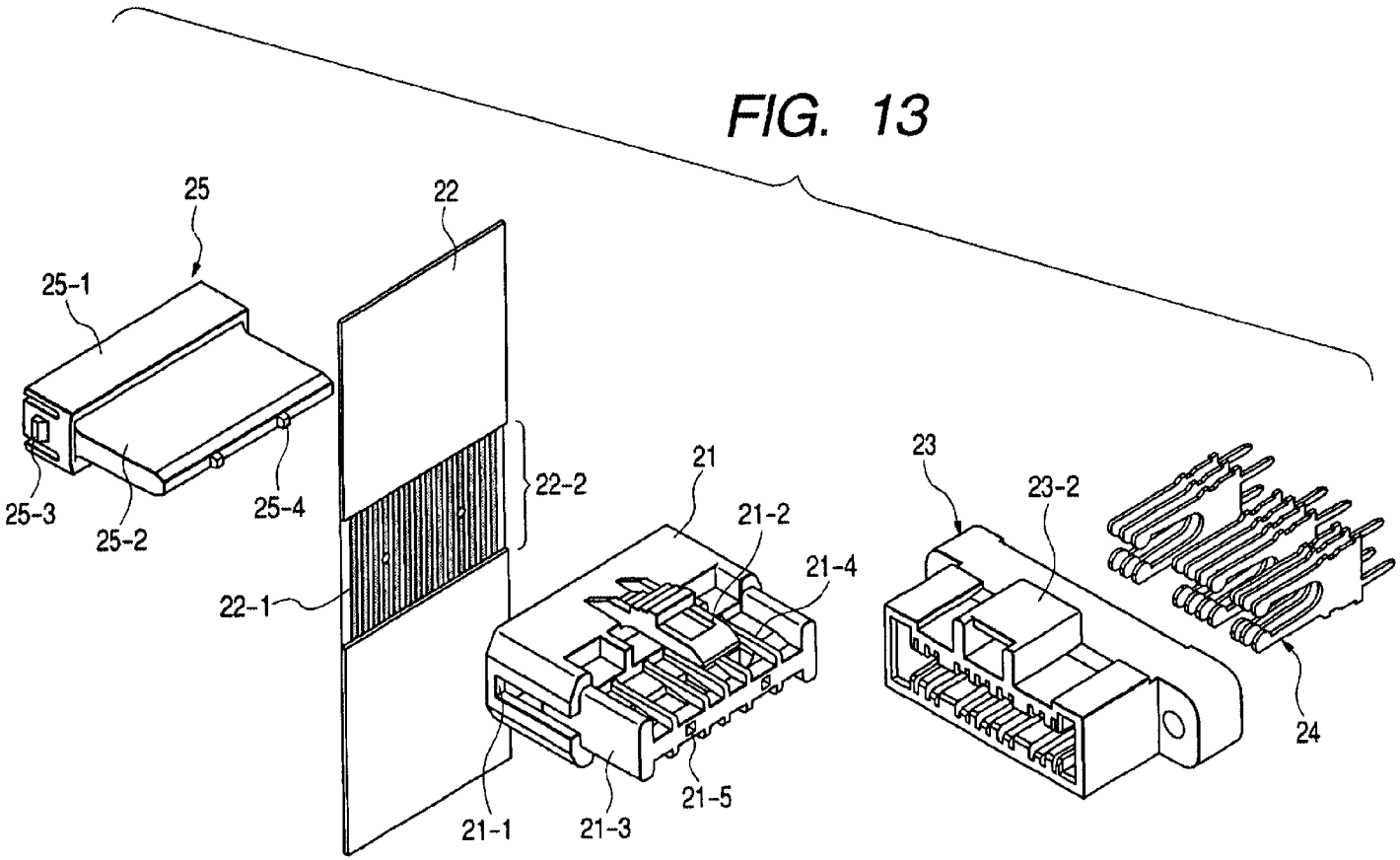
FIG. 13 is a perspective view of a male connector housing according to a third embodiment of the present invention.
Figure 14:
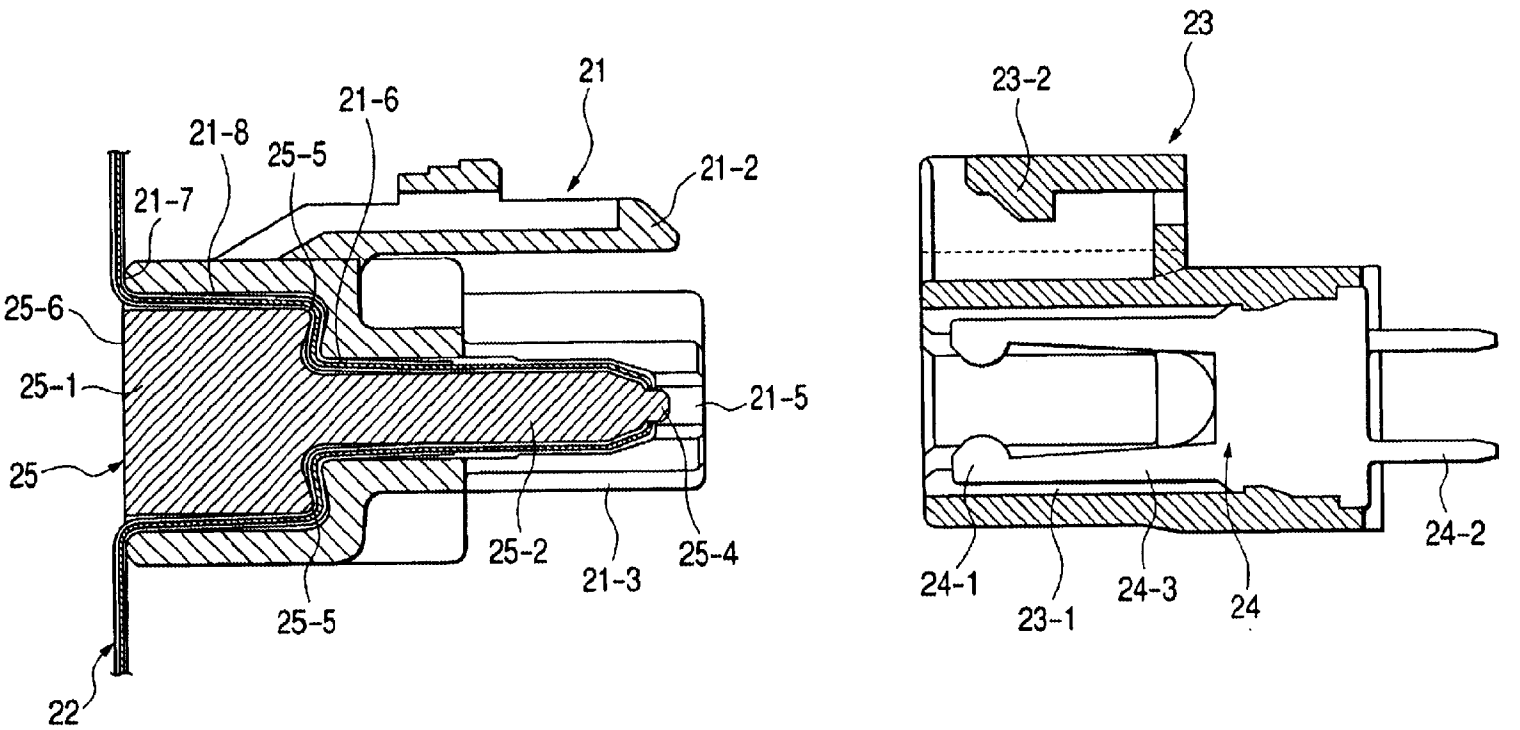
FIG. 14 is a cross-sectional view of the male connector housing according to the third embodiment.

FIG. 13 is a perspective view of a male connector housing and relevant sections according to a third embodiment of the present invention. FIG. 14 is a cross-sectional view of the male connector housing according to the third embodiment.

In the first and second embodiment, a connection section is provided in the end of the FFC. In contrast, the present embodiment differs from the first and second embodiments in that the connection section is provided outside the end of the FFC, thereby enabling an increase in the density of an electric circuit.

As shown in FIGS. 13 and 14, reference numeral 21 designates a male connector housing. A lock 21-2 is provided on an upper surface of the male connector housing 21. Further, the male connector housing 21 is provided with side walls 21-3 and guide ribs 21-4, which act as guides when a female connector housing 23 is engaged with the male connector housing 21.

Two layers of recesses are provided in the male connector housing 21, and release holes 21-5 for meshing with projections provided at the extremity of a retainer are formed-in the extremity of the male connector housing 21.

Reference numeral 22 designates an FFC having a predetermined circuit formed thereon; and 22-2 designates a copper foil section from which an insulation coating has been peeled. Holes 22-1 for locating purpose are formed in the center of the FFC 22.

Reference numeral 25 designates a retainer to be used for pushing and fastening the FFC 22 to the male connector housing 21. Formed in the retainer 25 are two projecting sections 25-1 matching with two recessed sections 21-8, and two projecting sections 25-2 matching with two recessed sections 21-6. Further, projections 25-4 for locating purpose are provided at the extremity of the retainer 25.

Reference numeral 23 designates a female connector housing. An engagement section 23-2 is provided on top of the female connector housing 23 for preventing disengagement of the female connector housing 23 from the male connector housing 21. A plurality of contact terminals 24 are to be fitted into an internal space 23-1. Each contact terminal 24 has two rod-like sections 24-3 and solder tails 24, and contacts 24-1 are provided at the extremities of the rod-like sections 24-3.

Attachment of the FFC 22 to the male connector housing 21 is performed through the following steps. As shown in FIG. 14, the projections 25-4 provided at the extremity of the retainer 25 are inserted into the holes 22-1 of the FFC 22. Subsequently, the two projecting sections 25-1, 25-2 are fit into the recessed sections 21-6, 21-8 until an end face 21-7 of the male connector housing 21 becomes flush with an end face 25-6 of the retainer 25.

At this position, engagement claws 25-3 provided on respective side surfaces of the retainer 25 are engaged with engagement sections 21-1 of the male connector housing 21, thus hindering disengagement of the retainer 25 from the male connector housing 21.

The FFC 22 is sandwiched, in a bent manner, between raised sections 25-2 of the retainer 25 and recessed sections of the male connector housing 21. Therefore, even when being pulled strongly, the FFC 22 is not susceptible to a rip which would arise from the periphery of the locating holes 22-1.

The male connector housing 21 is smoothly engaged with the female connector housing 23 while being guided by the side walls 21-3 and the guide ribs 21-4. The lock 21-2 of the male connector housing 21 is engaged with the engagement section 23-2 of the female connector housing 23.

The two rod-like sections 24-3 of the respective contact terminals 24 become elastically deformed, thereby pinching a copper foil section 22-2 of the FFC 22 from above and below. The copper foil section 22-2 of the FFC 22 is electrically connected to the contacts 24-1 over the upper and lower surfaces of the FFC 22, thereby constituting a predetermined electrical circuit.

In addition to the advantages yielded by the first and second embodiments, the present embodiment yields an advantage of the FFC 22 being folded through 180° to constitute electrical contact sections on the upper and lower surfaces of the FFC 22, thereby enabling an increase in the density of an electrical circuit and rendering the cost of parts lower.

The copper foil section 22-2 and the locating holes 22-1 are formed in several positions on the FFC 22 in the longitudinal direction thereof, by means of peeling off the insulation coating in the same manner as mentioned previously. So long as the male connector housings 21 according to the present embodiment are connected to the thus-peeled portions of the FFC 22, identical male connector housings 21 are connected in shunt with each other on the FFC 22. There is yielded an advantage of the ability to constitute a preferred wire harness from a smaller number of parts, by means of using the FFC 22 so as to interconnect circuit units which are to be connected together through multiplex communication.

Fourth Embodiment

Figure 15:
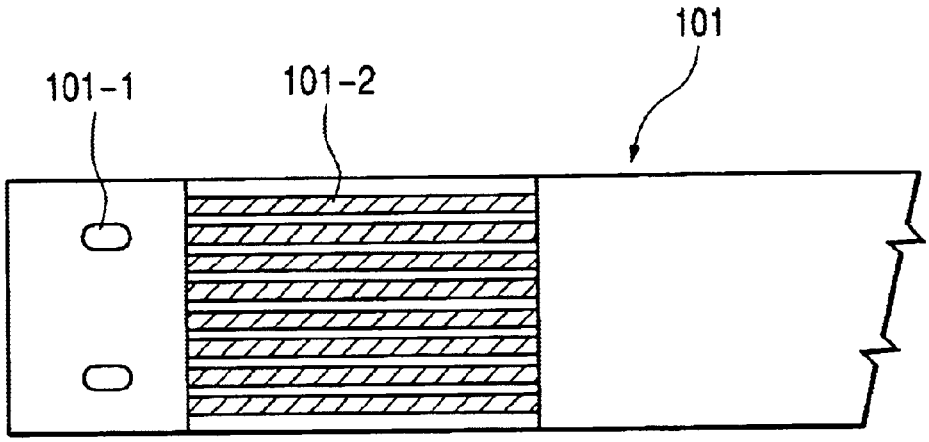
FIG. 15 is a plan view of an FFC according to a fourth embodiment of the present invention.
Figure 16:
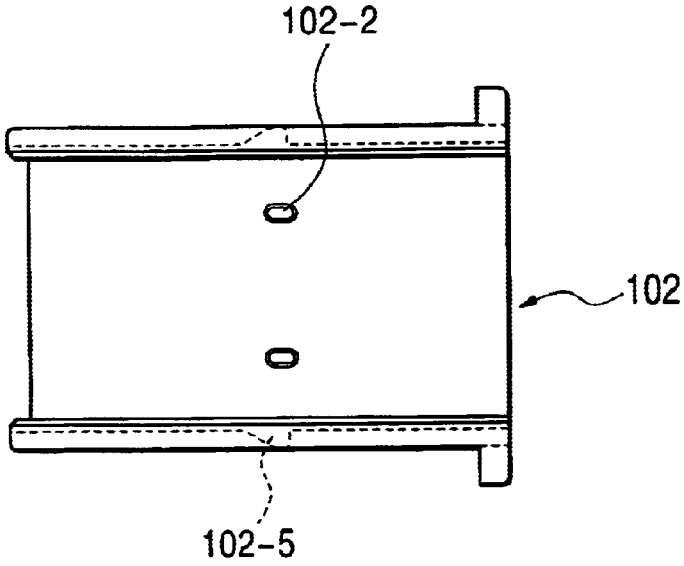
FIG. 16 is a plan view of a plug according to the fourth embodiment.
Figure 17:
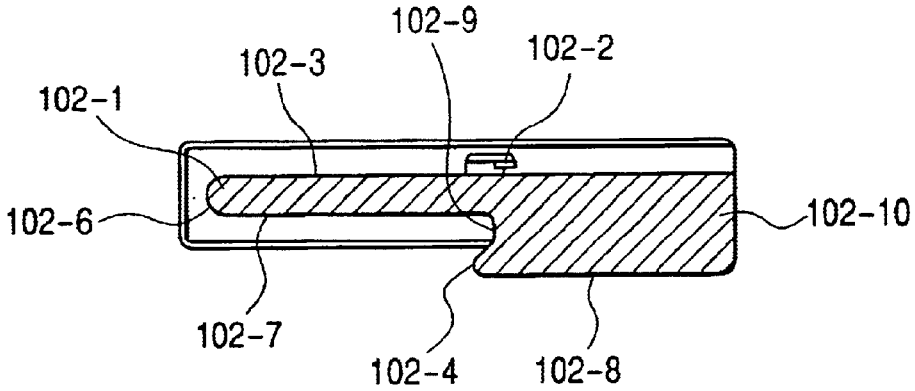
FIG. 17 is a cross-sectional view of the plug shown in FIG. 16.
Figure 18:
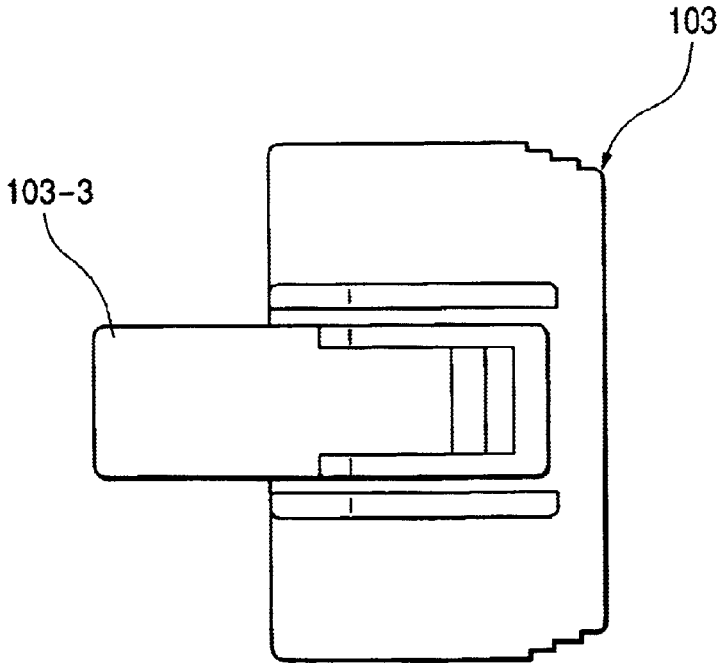
FIG. 18 is a plan view of a housing according to the fourth embodiment.
Figure 19:
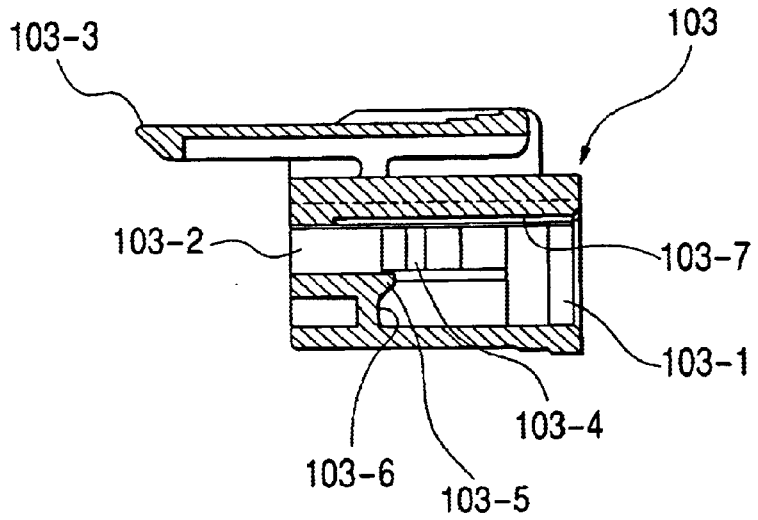
FIG. 19 is a cross-sectional view of the housing shown in FIG. 18.

FIG. 15 is a plan view of an FFC according to a fourth embodiment of the present invention; FIG. 16 is a plan view of a plug according to the fourth embodiment; FIG. 17 is a cross-sectional view of the plug shown in FIG. 16; FIG. 18 is a plan view of a housing according to the fourth embodiment; and FIG. 19 is a cross-sectional view of the housing shown in FIG. 18.

As shown in FIG. 15, reference numeral 101 designates an FFC onto which a flexible electrical insulation film and a copper foil are laminated. A predetermined electrical circuit is constituted on the copper foil, and conductor sections 101-2 of a connector section are exposed for electrical connection.

A plurality of holes 101-1 are formed in the FFC 101 so as to be engaged with a plurality of projections 102-2 provided on an upper surface of a plug when the FFC 101 is attached to the plug 102.

As shown in FIGS. 16 and 17, reference numeral 102 designates a plug made from resin. The plug 102 has an upper surface 102-3, and a half round section 102-6 is provided at one end of the plug 102. A lower surface of the plug 102 is formed into a two-stage lower surface, and a projecting section 102-4 and a recessed section 102-9 are provided at an interface between the two stages of the lower surface.

Reference numeral 102-1 designates a projecting boss having the half-round section 102-6. The boss 102-1 is fitted into a housing to be described later.

Reference numeral 102-5 designates engagement projections which are provided on respective side walls of the plug 102 and are engaged with lances of a housing to be described later.

As shown in FIGS. 18 and 19, reference numeral 103 designates a housing made from resin; that is, a connector housing formed from resin through injection molding. A large-diameter opening section 103-1 is formed in one end of the housing 103, and a small-diameter insertion hole 103-2 is formed in the other end of the housing 103. A projecting section 103-5 and a recessed section 103-6 are formed at a point along the way from the opening section 103-1 to the insertion hole 103-2.

Lances 103-4 are formed in the opening section 103-1.

Figure 20:
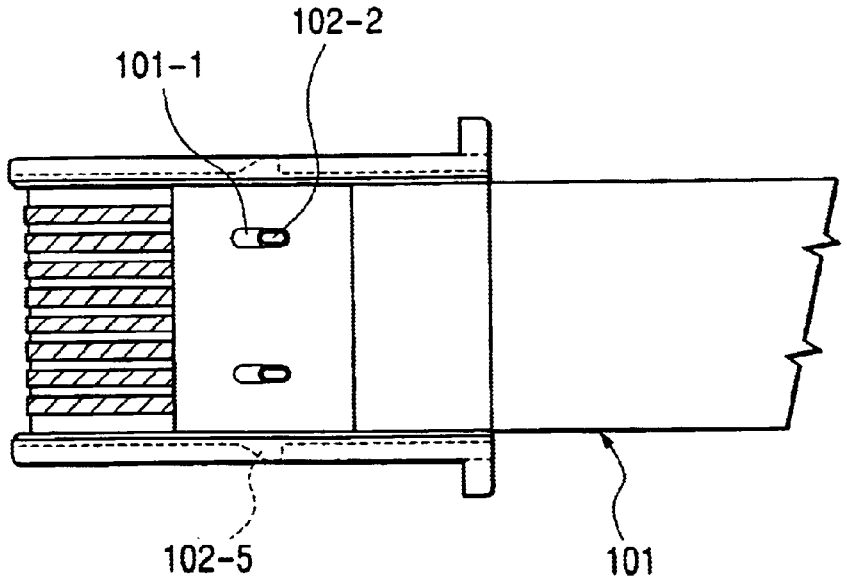
FIG. 20 is a plan view of the plug according to the fourth embodiment when an FFC is provided on the plug.
Figure 21:
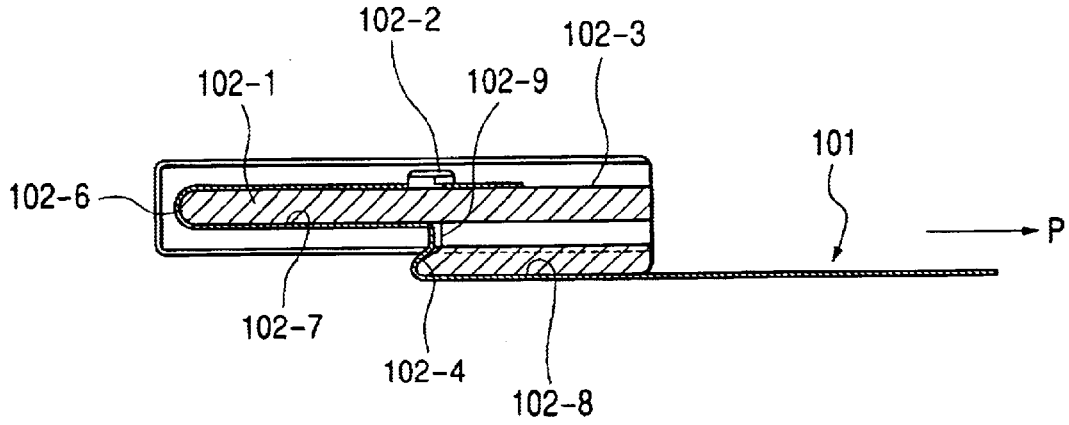
FIG. 21 is a cross-sectional view of the plug shown in FIG. 20.

FIG. 20 is a plan view of the plug according to the fourth embodiment when an FFC is provided on the plug, and FIG. 21 is a cross-sectional view of the plug shown in FIG. 20.

As shown in FIGS. 19 and 20, the engagement projections 102-2 provided on the upper surface of the plug 102 are engaged with the holes 101-1 formed in the extremity of the FFC 101. The FFC 101 is inserted along the upper surface 102-3 of the plug 102 and turned along the semi-half section 102-6 provided at the extremity of the plug 102. The thus-turned FFC 101 is further inserted along a first surface 102-7, the projection section 102-4, and a second surface 102-8.

Figure 22:
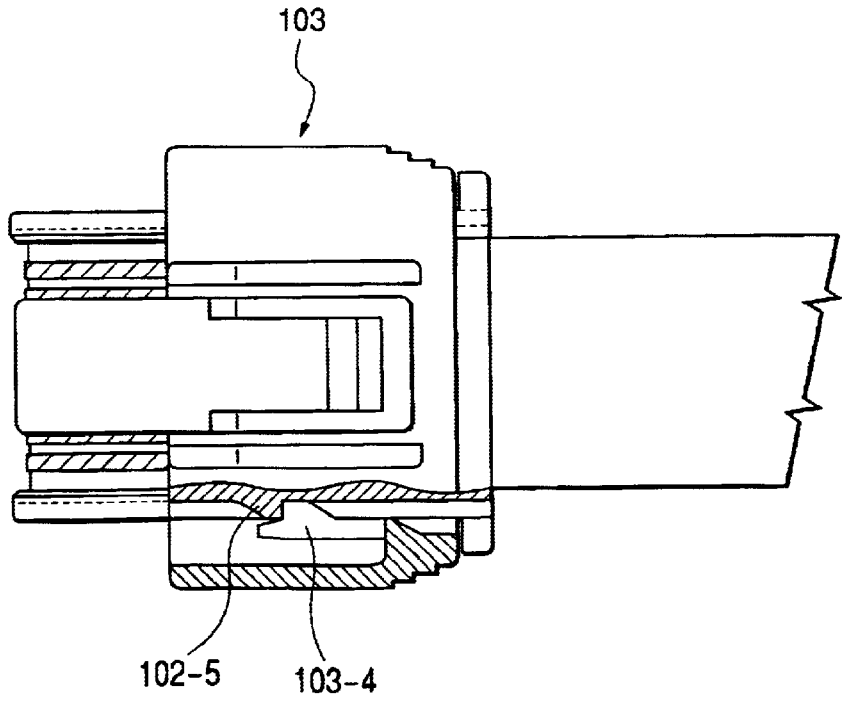
FIG. 22 is a plan view of the connector for connecting an FFC according to the fourth embodiment.
Figure 23:
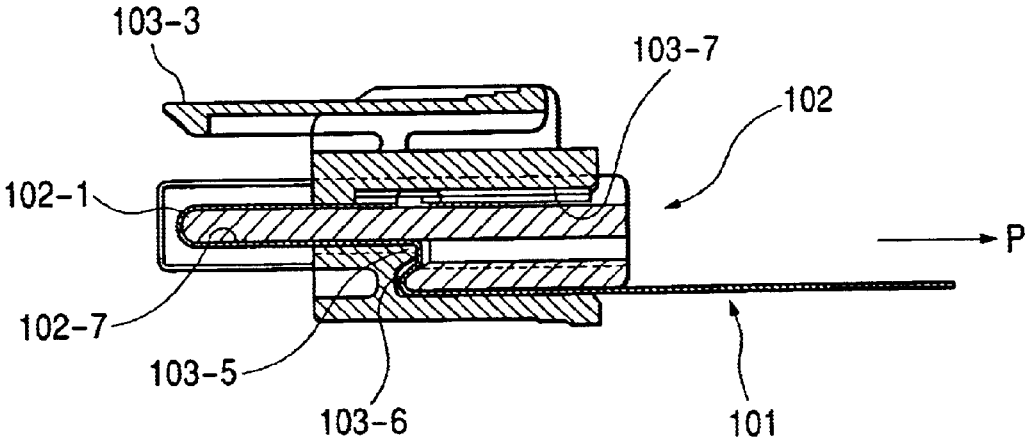
FIG. 23 is a cross-sectional view of the connector shown in FIG. 22.

FIG. 22 is a plan view of the connector for connecting an FFC according to the fourth embodiment, and FIG. 23 is a cross-sectional view of the connector shown in FIG. 22.

As shown in FIGS. 22 and 23, the plug 102 having the FFC 101 laid thereon is inserted into the housing 103 by way of the opening section 103-1 thereof, and the boss 102-1 is fitted into the insertion hole 103-2. The plug 102 is inserted to the extent that the Lances 103-4 of the housing are engaged with the projections 102-5 of the plug 102, thereby engaging the Lances 103-4 with the projections 102-5.

In this position, the projecting section 102-4 and the recessed section 102-9 of the plug 102 come into contact with the projecting section 103-5 and the recessed section 103-6 of the housing with the FFC 101 sandwiched therebetween, thus holding the FFC 101.

In this position, the engagement projections 102-2 of the plug 102 are housed in notches 103-7 formed in the housing.

When the plug 102 having the FFC 101 provided thereon is inserted into the opening section 103-1 of the housing, the FFC 101 located on the lower surface of the plug 102 does not need to remain in intimate contact with the lower surfaces 102-7, 102-8 of the plug 102. If the plug 102 is inserted into the opening section while being pulled gently in direction P (shown in FIG. 21), the FFC 101 is restricted and housed in a predetermined location, by means of an interior surface of the opening section 103-1 of the housing and the lower surfaces 102-7, 102-8 of the plug 102 as the boss 102-1 of the plug 102 is inserted into the insertion hole 103-2 of the housing.

The connector for connecting an FFC shown in FIG. 23 is inserted into a corresponding connector (not shown), and the lock 103-3 is engaged with an engagement projection (not shown) of the corresponding connector, thereby constituting a predetermined electrical circuit.

In the fourth embodiment, the projecting section 102-4 and the recessed section 102-9 of the plug 102 come into contact with the projecting section 103-5 and the recessed section 103-6 of the housing with the FFC 101 sandwiched therebetween, thus holding the FFC 101. Even when great tensile force is exerted on the FFC 101 in direction P (shown in FIG. 21), application of intensive stress to the surroundings of the holes 101-1 of the FFC 101 is prevented, and hence no rip arises around the holes 101-1.

Projections provided on the upper surface of the plug 102 act as engagement projections having claws at the tip ends thereof. When the plug 102 having the FFC 101 provided thereon is inserted into the opening section 103-1 of the housing, the FFC 101 is not disengaged from the engagement projections 102-2 of the plug 102, and hence superior workability is achieved.

Fifth Embodiment

FIG. 24 is a plan view of a plug having an FFC provided thereon according to a fifth embodiment of the present invention; FIG. 25 is a cross-sectional view of the plug shown in FIG. 24; and FIG. 26 is a cross-sectional view of a connector for connecting an FFC according to a fifth embodiment of the present invention.

In contrast with the fourth embodiment, as shown in FIGS. 24 through 26, the fifth embodiment is characterized in that a projecting section is provided at the end of the lower surface of the plug and that insertion holes 111-1 are formed at positions on an FFC 111 corresponding to the projecting section such that the projecting section act as a member for restricting the FFC 111. In other respects, the fifth embodiment is identical with the fourth embodiment.

In order to place the FFC 111 on a plug 112, one end of the FFC 111 is inserted into an insertion hole provided at the lower end of the plug 112. The FFC 111 is inserted along a second lower surface 112-8, a projecting section 112-4, a recessed section 112-9, and a first lower surface 112-7 of the plug 112. The FFC 111 is turned along a half-round section 112-6 provided at the extremity of the plug 112 and inserted further along an upper surface 112-3 of the plug 112. The holes 111-1 are engaged with engagement projections 112-2.

The only requirement for fitting the plug 112—which has the FFC 111 provided thereon and is shown in FIG. 25—into a housing 113 is to insert a boss 112-1 of the plug 112 into an insertion hole 113-2 by way of an opening section 113-1 of the housing 113 while the FFC 111 is pulled gently in direction P (shown in FIG. 25).

In the fifth embodiment, the projecting section 112-4 and the recessed section 112-9 of the plug 112 come into contact with the recessed section 113-6 and the projecting section 113-5 of the housing 113 with the FFC 111 sandwiched therebetween, as in the case of the fourth embodiment. Even when great tensile force is exerted on the FFC 111, application of intensive stress to the surroundings of the holes 111-1 of the FFC 111 is prevented, and hence no rip arises around the holes 111-1.

In the fifth embodiment, a restriction member 112-12 restricts drooping of the FFC 111 from the lower surfaces 112-7, 112-8 of the plug 112. Further, the direction in which the FFC 111 is to be pulled when the plug 112 is inserted into the opening section 113-1 of the housing 113 is not limited to the direction P and may be direction Q1 or Q2, whereby a job of attaching the plug 112 to the housing 113 is improved further.

Sixth Embodiment

FIG. 27 is a cross-sectional view of a male connector housing according to a sixth embodiment of the present invention (after an FFC has been inserted into the housing; the view corresponds to a cross-sectional view taken along line A—A shown in FIG. 29). FIG. 28 is a plan view of the male connector housing according to the sixth embodiment. FIG. 29 is a side view of the connector housing shown in FIG. 27 when viewed from the right. FIG. 30 is a left-side elevation view of the connector housing shown in FIG. 27 when viewed from the left.

As shown in FIGS. 27 through 30, reference numeral 201 designates a male connector housing formed from resin through injection molding; and 202 designates an FFC. Reference numeral 201-1 designates a lock member. An engagement claw 201-2 is provided on the extremity of the lock member 201-1. When the connector housing 201 is meshed with a female connector housing 203, the engagement claw 201-2 is engaged with an engagement projection 203-1 provided on the female connector housing 203.

Reference numeral 201-8 designates a guide used when the connector housing 201 is engaged with the female connector housing 203. One guide 201-8 is provided on either side of the connector housing 201, thus contributing to assurance of rigidity of the connector housing 201.

Reference numeral 201-13 designates a storage section into which the FFC 202 is to be inserted. A retaining section 201-12 for retaining the FFC 202 is provided below the storage section 1-13. An upper surface of the retaining section 201-12 acts as a retaining surface 201-15 for retaining the FFC 202. Further, reference numeral 201-11 designates a ceiling surface of the storage section 201-13. The ceiling surface 201-11 ends at substantially the center of the retaining surface 201-15.

Reference numeral 201-3 designates a guide groove used when the FFC 202 is inserted into the connector housing 201. The guide groove 1-3 is formed so as to extend from an insertion port 201-4 to root sections of the respective guides 201-8; that is, over substantially the entirety of the connector housing 201.

Alternatively, one or a plurality of guides 201-8 may be additionally provided in the center of the connector housing 201. Further, guide grooves analogous to the guide grooves 201-3 may be formed in the root sections of the guides 201-8.

Reference numeral 201-6 designates protuberances for holding the FFC 202 which are provided on the retaining surface 201-15. One surface of each protuberance 201-6 has a tapered surface 201-7.

Reference numeral 201-5 designates grooves which are formed in the ceiling surface 201-11, and each groove 201-5 has an U-shaped cross-sectional profile. The grooves 201-5 are situated at positions above the corresponding protuberances 201-6 provided on the retaining surface 201-15. The grooves 201-5 are formed over the entirety of the ceiling surface 201-11 so as to extend from the insertion port 201-4 for the FFC 202 to an end 201-16 opposite the end at which the insertion port 201-4 is located.

Reference numeral 201-9 designates protection projections provided on respective sides of the lock member 201-1. Engagement of the engagement claw 201-2 provided at the extremity of the lock member 201-1 with the engaging projection 203-1 of the male connector housing 203 carries out a protection function of preventing occurrence of inadvertent disengagement, which would otherwise arise when a connector is mounted on an automobile.

FIG. 31 is a plan view of an FFC according to the sixth embodiment. FIG. 32 is a descriptive view for describing the FFC according to the sixth embodiment when being inserted into the connector housing 201.

FIG. 33 is a descriptive view showing the FFC according to the sixth embodiment after having been inserted into the connector housing 201.

As shown in FIG. 31, reference numeral 202 designates an FFC; and 202-1 designates two holes provided side by side which are engaged with the protuberances 201-6 when the FFC 202 is inserted into the connector housing 201, thereby effecting positioning of the FFC 202 and preventing removal of the FFC 202.

Reference numeral 202-3 designates a conductor section constituting the circuitry of the FFC 202.

Insertion of the FFC 202 into the connector housing 201 is performed through the following processes. Namely, as shown in FIG. 32, an extremity of the FFC 202 is inserted into the insertion port 201-4 of the connector housing 201 along the guide grooves 201-3.

Upon arrival at the protuberances 201-6 of the connector housing 201, the extremity 202-2 of the FFC 202 comes into contact with the tapered surfaces 201-7 and is deformed upward in a raised manner. When being inserted further, the extremity 202-2 is deformed downward along the guide grooves 201-3, to come into collision with a longitudinal wall 201-10 of the connector housing 201. In this position, the protuberances 201-6 are engaged with the engagement holes 202-1, whereby insertion of the FFC 202 into the connector housing 201 is completed (FIG. 33).

In the present embodiment, the grooves 201-5, each having an U-shaped cross-sectional profile and being situated at positions above the protuberances 201-6, are formed over the entirety of the ceiling surface 201-11 so as to extend from the insertion port 201-4 for the FFC 202 to the end 201-16. Hence, the FFC 202 can be smoothly inserted into the connector housing 201 with no constraint being imposed on deformation of the FFC 202.

Since the FFC 202 is inserted while being guided by the guide grooves 201-3, the FFC 202 does not levitate from the surface of the retaining surface 201-15 of the connector housing 201. The extremity 202-2 is folded downward and housed in a shape restriction section 201-14. Further, the extremity 202-2 remains in contact with the longitudinal wall 201-10. Hence, when the connector housing 201 is inserted into the female connector housing 203, no snag arises.

FIG. 34 is a cross-sectional view of the female connector housing 203 according to the sixth embodiment when viewed from the front (after a contact terminal has been inserted into the housing, and the drawing corresponds to a cross-sectional view taken along line B—B shown in FIG. 36). FIG. 35 is a plan view of the female connector housing 203 according to the sixth embodiment of the invention, and FIG. 36 is a side view of the female connector housing 203 shown in FIG. 34 when viewed from the left.

As shown in FIGS. 34 through 36, reference numeral 203 designates a female connector housing formed from resin through injection molding.

Provided on the outside of the female connector housing 203 are an engagement projection 203-1 to be engaged with the lock-member 201-1 of the connector housing 201, and a protection member 203-2 for protecting the lock member 201-1. Further, an accommodation chamber 203-3 is formed in the female connector housing 203 for receiving the connector housing 201.

Four slits 203-5 into which contact terminals 204 are to be inserted are formed in the accommodation chamber 203-3. Further, guide grooves 203-4 to be engaged with the guides 201-8 of the connector housing 201 are formed at respective longitudinal ends of the accommodation chamber 203-3.

Locating pins 203-6 which effect positioning when the female connector housing 203 is mounted on a circuit board are provided at one end of the female connector housing 203.

The contact terminals 204 are formed from a brass plate through pressmolding. Two rod-like sections 204-3 are provided at one end of each of the contact terminals 204, and contacts 204-1 at formed at the extremities of the respective rod-like sections 204-3. A solder tail 204-2 to be soldered to a through hole of a circuit board (not shown) is formed on the other end of each contact terminal 204.

As shown in FIG. 34, attachment of the contact terminals 204 to the female connector housing 203 is completed by the following processes. Namely, as shown in FIG. 34, the contact terminals 204 are pushed into the slits 203-5 from the right end of the of the female connector housing 203, to thereby cause projections 4—4 of the contact terminals 204 to mesh with the bottom surfaces of the respective slits 203-5. An end face 203-7 of the female connector housing 203 is brought into contact with end faces 204-5 of the contact terminals 204.

FIG. 37 is a cross-sectional view of the connector housing 201 and the female connector housing 203 according to the present embodiment when they are engaged with each other.

Engagement of the connector housing 201 having the FFC 202 inserted therein with the female connector housing 203 having the contact terminals 204 incorporated therein is performed through the following processes. As shown in FIG. 37, the connector housing 201 is inserted into the female connector housing 203 while the guides 201-8 are engaged with the guide grooves 203-4. The extremity of the retaining section 201-12 of the connector housing 201 comes into collision with the contacts 204-1 of the contact terminals 204, thereby resiliently deforming the rod-like sections 204-3 of the contact terminals 204. The contacts 204-1 are electrically connected to the conductor sections 202-3 of the FFC 202, thereby constituting a predetermined electrical circuit. The engagement claws 201-2 of the lock-member 201-1 of the connector housing 201 pass across and mesh with the engagement projections 203-1 of the female connector housing 203.

At the time of engagement of the connector housing 201 with the female connector housing 203, they can be smoothly engaged by means of the guides 201-8 of the connector housing 201 being engaged with the guide grooves 203-4 of the female connector housing 203.

In contrast with the related-art male connector housing, the connector housing 201 is not divided into two parts; that is, the base member 255 and the fixing member 256. Hence, the cost of parts is lowered, and ease of assembly is achieved.

According to the invention, an FFC is fastened in a male connector housing in a folded manner. Hence, even when the FFC is pulled strongly, a rip does not arise in the periphery of lock projections.

The FFC is inserted into the male connector housing by way of an opening section thereof along a slit, thus realizing ease of attachment.

As long as the male connector housing is formed integrally with a retainer, the cost of parts is lowered, thereby facilitating attachment of the retainer to a much greater extent.

According to the invention, since the male connector housing is provided with guide ribs which act as guides when a female connector housing is engaged with the male connector housing, ease of engagement is achieved.

According to the invention, the FFC is fastened in the male connector housing in a folded manner. Hence, even when the FFC is pulled strongly, a rip does not arise in the periphery of the engagement projections.

Even when being pulled, the FFC is strongly sandwiched between a male connector housing and a retaining member and becomes stable.

The only requirement for achieving secure engagement is to insert the FFC into the connector housing along the slits formed in the retaining member, thereby realizing superior workability.

According to the invention, the male connector housing, an insertion port, and the slits of a temporarily-held retaining member are level with each other. Hence, ease of attachment of the FFC is improved further. There is yielded an advantage of an improvement in an operation for inserting a retaining member into a male connector housing.

According to the invention, the FFC is folded through 180°, and an electrical connection section is formed on either of upper and lower surfaces of the thus-folded FFC. Hence, the density of an electrical circuit can be increased, thereby yielding an advantage of rendering the cost of parts lower So long as the connector for use in connecting an FFC according to the present invention is attached to a plurality of positions on the FFC 22 in a longitudinal direction thereof, identical male connectors 21 are connected in shunt with each other on the FFC. As a result, there is yielded an advantage of the ability to constitute, from a smaller number of components, a wire harness suitable for use in connecting circuit units which are to be coupled together through multiplex communication.

According to the invention, the FFC is fastened to the inside of the male connector housing in a folded manner. Hence, even when the FFC is pulled strongly, a rip will not arise in the periphery of engagement projections.

According to the invention, a projecting section and a recessed section of a plug come into contact with a recessed section and a projecting section of a housing with an FFC sandwiched therebetween, thus holding the FFC. Hence, even when great tensile force is exerted on the FFC, application of intensive stress to the surroundings of the holes of the FFC is prevented, thereby preventing occurrence of a rip around the holes.

According to the invention, a restriction member 112-12 restricts drooping of the FFC 111 from the lower surfaces 112-7, 112-8. As a result, there is yielded an advantage of affording a greater degree of freedom of a direction in which tensile force is to be exerted on an FFC when a plug is inserted into an opening section of a housing, as well as an advantage of an improvement in ease of attachment of a plug to a housing.

According to the invention, a male connector housing is integrally formed from resin. Hence, there is yielded an advantage of the cost of parts being lowered.

Protuberances to be engaged with engagement holes formed in an FFC are provided on a retaining surface for retaining an FFC of a male connector housing. Warpage spaces for an FFC are provided on a ceiling surface situated at a position above the protuberances. Each of the spaces has an U-shaped cross-sectional profile, and the spaces are formed so as to extend from an insertion port for an FFC to an end opposite an end at which the insertion port is provided. Hence, when an FFC is inserted into the male connector housing, the FFC is deformed upward in a raised manner upon arrival at the protuberances. There is yielded an advantage of the ability to smoothly insert an FFC into a male connector housing without constraints being imposed on deformation of the FFC.

Since the FFC is inserted while being guided by the guide grooves, the FFC does not levitate from the retaining surface of the male connector housing. Namely, the extremity of the FFC is folded downward and housed in a shape restriction section of the male connector housing and remains in contact with a longitudinal wall. Hence, there is yielded an advantage of no snag arising when the male connector housing is engaged with the female connector housing.

What is claimed is:

1. A connector for connecting a FFC, the connector comprising:

a male connector housing having a plurality of slits along which a FFC is inserted;

a retainer formed integral to the male connector housing for fastening the FFC to the male connector housing; and a hinge coupling the male connector housing and the retainer, wherein when the retainer is forced into an insertion side of the FFC and engaged with the male connector housing the hinge is in a folded configuration; and the FFC is folded and fastened between the retainer and the male connector housing.

2. The connector according to claim 1, wherein the male connector housing includes a plurality of guide ribs; and each of the slits are formed in a root of each of the guide ribs of the male connector housing.

3. The connector according to claim 1, further comprising:

projections provided at respective ends of the retainer; and indentations in the mail connector housing that engage with the projections.

4. The connector according to claim 1, further comprising:

a lock for preventing removal of the male connector housing from a corresponding female connector.

5. The connector according to claim 2, further comprising:

a pair of opposing side walls on the male connector housing, wherein the FFC extends between the side walls, and the guide ribs are arranged between the side walls.

6. The connector according to claim 1, wherein the retainer, hinge and mail connector are integrally formed together as a single piece.

* * * * *